US006832175B2

(12) United States Patent
Adachi et al.

(10) Patent No.: US 6,832,175 B2
(45) Date of Patent: Dec. 14, 2004

(54) METHOD FOR MANAGING CONSTRUCTION MACHINE, AND ARITHMETIC PROCESSING APPARATUS

(75) Inventors: Hiroyuki Adachi, Tsuchiura (JP); Toichi Hirata, Ushiku (JP); Genroku Sugiyama, Ibaraki-ken (JP); Hiroshi Watanabe, Ushiku (JP); Shuichi Miura, Koshigaya (JP); Koji Mitsuya, Kashiwa (JP); Yoshiaki Saito, Adachi-ku (JP); Atsushi Sato, Soka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 10/240,117

(22) PCT Filed: Mar. 30, 2001

(86) PCT No.: PCT/JP01/02740

§ 371 (c)(1),
(2), (4) Date: Sep. 27, 2002

(87) PCT Pub. No.: WO01/73217

PCT Pub. Date: Oct. 4, 2001

(65) Prior Publication Data

US 2003/0093204 A1 May 15, 2003

(30) Foreign Application Priority Data

Mar. 31, 2000 (JP) ..... 2000-97953

(51) Int. Cl.[7] ..... G04F 1/00; G04F 10/00; G04F 3/00; G04F 5/00; G04F 7/00

(52) U.S. Cl. ..... 702/177; 702/185; 702/182; 702/60; 702/34; 701/50; 700/29; 700/110; 37/348

(58) Field of Search ..... 702/60, 110, 50, 702/177, 182, 185; 37/348; 701/50; 700/29, 110

(56) References Cited

U.S. PATENT DOCUMENTS

| | | | | | |
|---|---|---|---|---|---|
| 5,737,215 | A | * | 4/1998 | Schricker et al. | 700/29 |
| 5,754,451 | A | * | 5/1998 | Williams | 702/185 |
| 5,903,459 | A | * | 5/1999 | Greenwood et al. | 700/110 |
| 6,041,287 | A | * | 3/2000 | Dister et al. | 702/182 |
| 6,141,629 | A | | 10/2000 | Yamamoto et al. | |
| 6,144,924 | A | * | 11/2000 | Dowling et al. | 702/60 |
| 6,195,922 | B1 | * | 3/2001 | Stump | 37/348 |
| 6,449,884 | B1 | * | 9/2002 | Watanabe et al. | 37/348 |
| 6,594,589 | B1 | * | 7/2003 | Coss et al. | 702/34 |
| 2002/0032511 | A1 | * | 3/2002 | Murakami et al. | 701/50 |

FOREIGN PATENT DOCUMENTS

| | | |
|---|---|---|
| JP | 1-288991 | 11/1989 |
| JP | 3-17321 | 1/1991 |
| JP | 2584371 | 8/1998 |
| JP | 11-36381 | 2/1999 |

* cited by examiner

*Primary Examiner*—John Barlow
*Assistant Examiner*—Aditya Bhat
(74) *Attorney, Agent, or Firm*—Mattingly, Stanger & Malur, P.C.

(57) ABSTRACT

A hydraulic excavator 1 working in fields includes a controller 2 for measuring a working time for each of an engine 32, a front 15, a swing body 13, and a travel body 12, storing measured data in a memory of the controller 2, and then transferring it to a base station computer 3 via satellite communication, an FD, etc. The transferred data is stored as a database 100 in the base station computer 3. The base station computer 3 reads the data stored in the database 100 for each hydraulic excavator, calculates a working time of a part belonging to each section on the basis of the working time of that section, and compares the calculated working time with a preset target replacement time interval of the relevant part, thereby calculating a remaining time up to next replacement of the relevant part and managing the scheduled replacement timing thereof. Thus, the appropriate scheduled replacement timing of parts can be determined even in a construction machine having a plurality of sections that differ in working time from each other.

8 Claims, 30 Drawing Sheets

FIG.9

OPERATION DATABASE PER MACHINE MODEL AND NUMBER

| | MODEL A NO. N | | | |
|---|---|---|---|---|
| 1 | JAN. 1, 2000 | $T_{NE}(1)$ | $T_D(1)$ | ··· |
| ⋮ | | ⋮ | | |
| K | MARCH 16, 2000 | $T_{NE}(K)$ | $T_D(K)$ | ··· |
| | | ⋮ | | |

MODEL A NO. N+1

MODEL A NO. N+2

···

ACTUAL MAINTENANCE DATABASE PER MACHINE MODEL AND NUMBER

| | MODEL A NO. N | |
|---|---|---|
| | ENGINE OIL FILTER REPLACEMENT TIME INTERVAL (CUMULATIVE VALUE) | |
| 1 | $T_{EF}(1)$ | ··· e.g., 3400 hr |
| ⋮ | ⋮ | |
| L | $T_{EF}(L)$ | ··· e.g., 12500 hr |
| | FRONT BUSHING REPLACEMENT TIME INTERVAL (CUMULATIVE VALUE) | |
| 1 | $T_{FB}(1)$ | ··· e.g., 5100 hr |
| ⋮ | ⋮ | |
| M | $T_{FB}(M)$ | ··· e.g., 14900 hr |
| | ⋮ | |

MODEL A NO. N+1

MODEL A NO. N+2

···

TARGET MAINTENANCE DATABASE PER MACHINE MODEL

| MODEL A |
|---|
| ENGINE OIL FILTER TARGET REPLACEMENT TIME INTERVAL $T_{M-EF}$ ··· e.g., 4000 hr |
| FRONT BUSHING TARGET REPLACEMENT TIME INTERVAL $T_{M-FB}$ ··· e.g., 5000 hr |
| ⋮ |

MODEL B

MODEL C

···

MACHINE MODEL OOOOO MACHINE NO. × × × ×

NOV 26 TO DEC. 26, 2000

| DATE | OIL SUPPLY | HOUR METER INDICATING START OF WORKING | WORKING TIME (HR) | AMOUNT OF FUEL REMAINING(%) | EXCAVATION | SWING | TRAVEL |
|---|---|---|---|---|---|---|---|
| 11/26 | | 1238 | 7.0 | 30 | 5.5 | 0.5 | 1.0 |
| 11/27 | | 1245 | 7.6 | 40 | 5.9 | 0.8 | 0.9 |
| 11/28 | | 1253 | 7.8 | 35 | 6.2 | 0.4 | 1.2 |
| 11/29 | | 1260 | 7.0 | 45 | 6.0 | 0.4 | 0.9 |
| 11/30 | | 1268 | 7.7 | 80 | 6.3 | 0.1 | 1.0 |
| 12/1 | | | 8.0 | 70 | 6.5 | 0.4 | 1.1 |
| 12/2 | | | | 70 | | | |
| 12/3 | | | 7.0 | 65 | 5.8 | 0.4 | 0.8 |
| 12/4 | | | 7.2 | 40 | : | : | : |
| 12/5 | | | 8.6 | 45 | : | : | : |
| 12/6 | | | 7.6 | 89 | : | : | : |
| 12/7 | | 1314 | 7.8 | 76 | : | : | : |
| 12/8 | | 1322 | 7.4 | 65 | : | : | : |
| 12/9 | | 1329 | | 65 | | | |
| 12/10 | | 1329 | 7.4 | 50 | : | : | : |
| 12/11 | | 1336 | 7.7 | 45 | : | : | : |
| 12/12 | | 1344 | 7.5 | 90 | : | : | : |
| 12/13 | | 1352 | 8.0 | 80 | : | : | : |
| 12/14 | | 1360 | 7.5 | 77 | : | : | : |
| 12/15 | | 1367 | 8.0 | 70 | : | : | : |
| 12/16 | | 1375 | | 70 | | | |
| 12/17 | | 1375 | 7.6 | 65 | : | : | : |
| 12/18 | | 1383 | 7.7 | 60 | : | : | : |
| 12/19 | | 1391 | 8.3 | 55 | : | : | : |
| 12/20 | | 1399 | 8.0 | 50 | : | : | : |
| 12/21 | | 1407 | 8.0 | 45 | : | : | : |
| 12/22 | | 1415 | 7.4 | 40 | : | : | : |
| 12/23 | | 1422 | | 40 | | | |
| 12/24 | | 1422 | 7.4 | 37 | : | : | : |
| 12/25 | | 1430 | 7.8 | 35 | : | : | : |
| 12/26 | | 1437 | 7.4 | 30 | : | : | : |
| | | | TOTAL 213.1 | | | | |

OIL SUPPLY AMOUNT 4710 (LITER)

AMOUNT OF FUEL CONSUMED 22.1 (LITER/HR)

FIG. 24

| OCCURRENCE DATE | TIME OF DAY | TYPE | |
|---|---|---|---|
| 2000 1.1 | 13:00 | ENGINE OIL WARNING | ON<br>OFF |
| 2000 1.2 | 15:00 | WATER TEMPERATURE WARNING | ON<br>OFF |
| ⋮ | | ⋮ | |

FIG. 28

ACTUAL MAINTENANCE DATABASE PER MACHINE MODEL AND NUMBER

| | MODEL A NO. N | MODEL A NO. N+1 | MODEL A NO. N+2 |
|---|---|---|---|
| | ENGINE OIL FILTER REPLACEMENT TIME INTERVAL (CUMULATIVE VALUE) | | |
| 1 | $T_{EF}(1)$ ··· e.g., 3400 hr | | |
| ⋮ | ⋮ | | |
| L | $T_{EF}(L)$ ··· e.g., 12500 hr | | |
| | FRONT BUSHING REPLACEMENT TIME INTERVAL (CUMULATIVE VALUE) | | ··· |
| 1 | $T_{FB}(1)$ ··· e.g., 5100 hr | | |
| ⋮ | ⋮ | | |
| M | $T_{FB}(M)$ ··· e.g., 14900 hr | | |
| | ⋮ | | |
| | ENGINE REPAIR TIME INTERVAL (CUMULATIVE VALUE) | | |
| 1 | $T_{ENR}(1)$ ··· e.g., 4100 hr | | |
| ⋮ | ⋮ | | |
| K | $T_{ENR}(K)$ ··· e.g., 18000 hr | | |
| | HYDRAULIC PUMP REPAIR TIME INTERVAL (CUMULATIVE VALUE) | | |
| 1 | $T_{HP}(1)$ ··· e.g., 2500 hr | | |
| ⋮ | ⋮ | | |
| N | $T_{HP}(N)$ ··· e.g., 16200 hr | | |
| | ⋮ | | |

FIG.29

TARGET MAINTENANCE DATABASE PER MACHINE MODEL

| MODEL A | MODEL B | MODEL C | ... |
|---|---|---|---|
| ENGINE OIL FILTER TARGET REPLACEMENT TIME INTERVAL $T_{M-EF}$ ··· e.g., 4000 hr | | | |
| FRONT BUSHING REPLACEMENT TARGET TIME INTERVAL $T_{M-FB}$ ··· e.g., 5000 hr | | | |
| ⋮ | | | |
| ENGINE TARGET REPAIR TIME INTERVAL $T_{M-EN}$ ··· e.g., 6000 hr | | | |
| HYDRAULIC PUMP TARGET REPAIR TIME INTERVAL $T_{M-HP}$ ··· e.g., 5000 hr | | | |
| ⋮ | | | |

METHOD FOR MANAGING CONSTRUCTION MACHINE, AND ARITHMETIC PROCESSING APPARATUS

TECHNICAL FIELD

The present invention relates to a method and system for managing a construction machine, and a processing apparatus. More particularly, the present invention relates to a method and system for managing a construction machine, such as a hydraulic excavator, which has a plurality of sections different in working time from each other, e.g., a front operating mechanism section, a swing section and a travel section, as well as to a processing apparatus.

BACKGROUND ART

To determine the scheduled repair/replacement timing of a part in a construction machine such as a hydraulic excavator, it is required to know the past working time of the part. Heretofore, the working time of each part has been calculated on the basis of the engine running time. As a result, the scheduled repair/replacement timing of parts has been calculated on the basis of the engine running time.

In a maintenance monitoring apparatus disclosed in JP,A 1-288991, for example, a time during which an engine is running (engine running time) is measured using a timer based on an output from a sensor for detecting the hydraulic pressure of an engine oil or an output from a sensor for detecting power generation of an alternator, and the engine running time measured using the timer is subtracted from the target replacement time of the relevant part, which is stored in a memory. Then, the resulted time difference is displayed on a display means. By checking the displayed time difference, each part including, e.g., oil and an oil filter, can be replaced without missing the proper timing of replacement of the part.

DISCLOSURE OF THE INVENTION

However, the above-described prior art has problems as follows.

In a construction machine such as a hydraulic excavator, parts to be subjected to maintenance include not only an engine oil and an engine oil filter, but also parts of a front as a working mechanism, including a bucket prong, a front pin (e.g., a joint pin between a boom and an arm), a bushing around the front pin, the arm and a bucket themselves serving as front parts, parts of a swing device, including a swing transmission oil, a swing transmission seal and a swing wheel, as well as parts of a travel device, including a track transmission oil, a track transmission seal, a track shoe, a track roller and a track motor. Of those parts, the engine oil and the engine oil filter are parts working during the engine operation. The front bucket prong, the front pin (e.g., the joint pin between the boom and the arm), and the bushing around the front pin, the arm and the bucket are parts working during the front operation (excavation). The swing transmission oil, the swing transmission seal and the swing wheel are parts working during the swing operation. The track transmission oil, the track transmission seal, the track shoe, the track roller and the track motor are parts working during the travel operation.

The engine, the front, the swing body and the travel body are sections different in working time from each other, and each have a specific working (operating) time. More specifically, the engine starts running upon turning-on of a key switch, whereas the front, the swing body and the travel body start working upon the operator operating them while the engine is running. Accordingly, the engine running time, the front operating time, the swing time and the travel time have different values from each other.

In spite of such situations regarding the working time for each section, the part working time has been uniformly calculated on the basis of the engine running time. Therefore, the working time of each of parts associated with the front, the swing body and the travel body, which has been calculated on the basis of the engine running time, differs from the actual working time, and the scheduled repair/replacement timing calculated from the measured working time cannot be said as being appropriate one. This has resulted in a problem that the part is repaired or replaced in spite of the part being still usable, or it is damaged prior to reaching the scheduled repair/replacement timing.

The engine, a main pump, a pilot pump, an alternator, etc. also have suffered from a similar problem, i.e., one that the part is repaired in spite of the part being still usable, or it is damaged prior to reaching the scheduled repair timing.

An object of the present invention is to provide a method and system for managing a construction machine, and a processing apparatus, with which the appropriate scheduled repair/replacement timing of parts can be decided even in a construction machine having a plurality of sections that differ in working time from each other.

(1) To achieve the above object, the present invention provides a method for managing a construction machine, the method comprising a first step of measuring a working time for each of sections of a construction machine, and storing and accumulating the measured working time as operation data in a database; and a second step of reading the operation data and calculating the scheduled repair/replacement timing of a part belonging to each section on the basis of the working time of that section.

With those features, since the repair/replacement timing of a part belonging to each section is calculated on the basis of the working time of that section, an appropriate scheduled repair/replacement timing of parts can be decided even in a construction machine having a plurality of sections that differ in working time from each other.

(2) In above (1), preferably, the second step includes steps of calculating, based on the read operation data, a working time of a part belonging to each section on the basis of the working time of that section, and comparing the calculated working time with a preset target repair/replacement time interval, thereby calculating a remaining time up to next repair/replacement of the relevant part.

With those features, since the remaining time up to next repair/replacement of a part belonging to each section is calculated on the basis of the working time of that section, the appropriate scheduled repair/replacement timing of parts can be decided even in a construction machine having a plurality of sections that differ in working time from each other.

(3) Further, to achieve the above object, the present invention provides a method for managing a construction machine, the method comprising a first step of measuring a working time for each of sections in each of a plurality of construction machines, transferring the measured working time for each section to a base station computer, and storing and accumulating the transferred working time as operation data in a database; and a second step of, in the base station computer, reading the operation data regarding a particular construction machine from the database and calculating a scheduled repair/-replacement timing of a part belonging to each section on the basis of the working time of that section.

With those features, as stated in above (1), the appropriate scheduled repair/replacement timing of parts can be decided even in a construction machine having a plurality of sections that differ in working time from each other. In addition, the scheduled repair/replacement timing of respective parts in a plurality of construction machines working in fields can be managed together in a base station.

(4) In above (3), preferably, the second step includes steps of calculating, based on the read operation data, a working time of a part belonging to each section on the basis of the working time of that section, and comparing the calculated working time with a preset target repair/replacement time interval, thereby calculating a remaining time up to next repair/replacement of the relevant part.

With those features, as stated in above (2), the appropriate scheduled repair/replacement timing of parts can be decided even in a construction machine having a plurality of sections that differ in working time from each other. In addition, the scheduled repair/replacement timing of respective parts in a plurality of construction machines working in fields can be managed together in a base station.

(5) In above (1) to (4), preferably, the construction machine is a hydraulic excavator, and the sections include a front, a swing body, a travel body, an engine, and a hydraulic pump of the hydraulic excavator.

With those features, the scheduled repair/replacement timing can be decided for each of parts belonging to the front, the swing body and the travel body of the hydraulic excavator, as well as for the engine and the hydraulic pump thereof.

(6) Also, to achieve the above object, the present invention provides a system for managing a construction machine, the system comprising operation data measuring and collecting means for measuring and collecting a working time for each of sections in each of a plurality of construction machines; and a base station computer installed in a base station and having a database for storing and accumulating, as operation data, the working time measured and collected for each section, the base station computer reading the operation data of a particular construction machine from the database and calculating a scheduled repair/replacement timing of a part belonging to each section on the basis of the working time of that section.

By using such a system, the managing methods of above (1) and (3) can be implemented.

(7) In above (6), preferably, the base station computer calculates, based on the operation data based on the read operation data, a working time of a part belonging to each section on the basis of the working time of that section, and compares the calculated working time with a preset target repair/replacement time interval, thereby calculating a remaining time up to next repair/replacement of the relevant part.

By using such a system, the managing methods of above (2) and (4) can be implemented.

(8) In above (6) and (7), preferably, the construction machine is a hydraulic excavator, and the sections include a front, a swing body, a travel body, an engine, and a hydraulic pump of the hydraulic excavator.

With those features, the managing method of above (5) can be implemented.

(9) Moreover, to achieve the above object, the present invention provides a processing apparatus which stores and accumulates, as operation data in a database, a working time for each of sections in each of a plurality of construction machines, reads the operation data regarding a particular construction machine from the database, and calculates a scheduled repair/replacement timing of a part belonging to each section on the basis of the working time of that section.

By using such a processing apparatus, the managing system of above (6) can be constructed.

(10) In addition, to achieve the above object, the present invention provides a processing apparatus which stores and accumulates, as operation data in a database, a working time for each of sections in each of a plurality of construction machines, reads the operation data regarding a particular construction machine from the database, calculates a working time of a part belonging to each section on the basis of the working time of that section, and compares the calculated working time with a preset target repair/replacement time interval, thereby calculating a remaining time up to next repair/replacement of the relevant part.

By using such a processing apparatus, the managing system of above (7) can be constructed.

BRIEF DESCRIPTION OF THE DRAWINGS

FIG. 9 shows how operation data, actual maintenance data, and target maintenance data are stored as a database in the base station center server.

FIG. 24 shows one example of a diagnostic report transmitted to the in-house computer and the user side computer.

FIG. 28 shows how actual maintenance data is stored as a database in the base station center server.

FIG. 29 shows how target maintenance data is stored as a database in the base station center server.

BEST MODE FOR CARRYING OUT THE INVENTION

Embodiments of the present invention will be described below with reference to the drawings.

Figure 1:
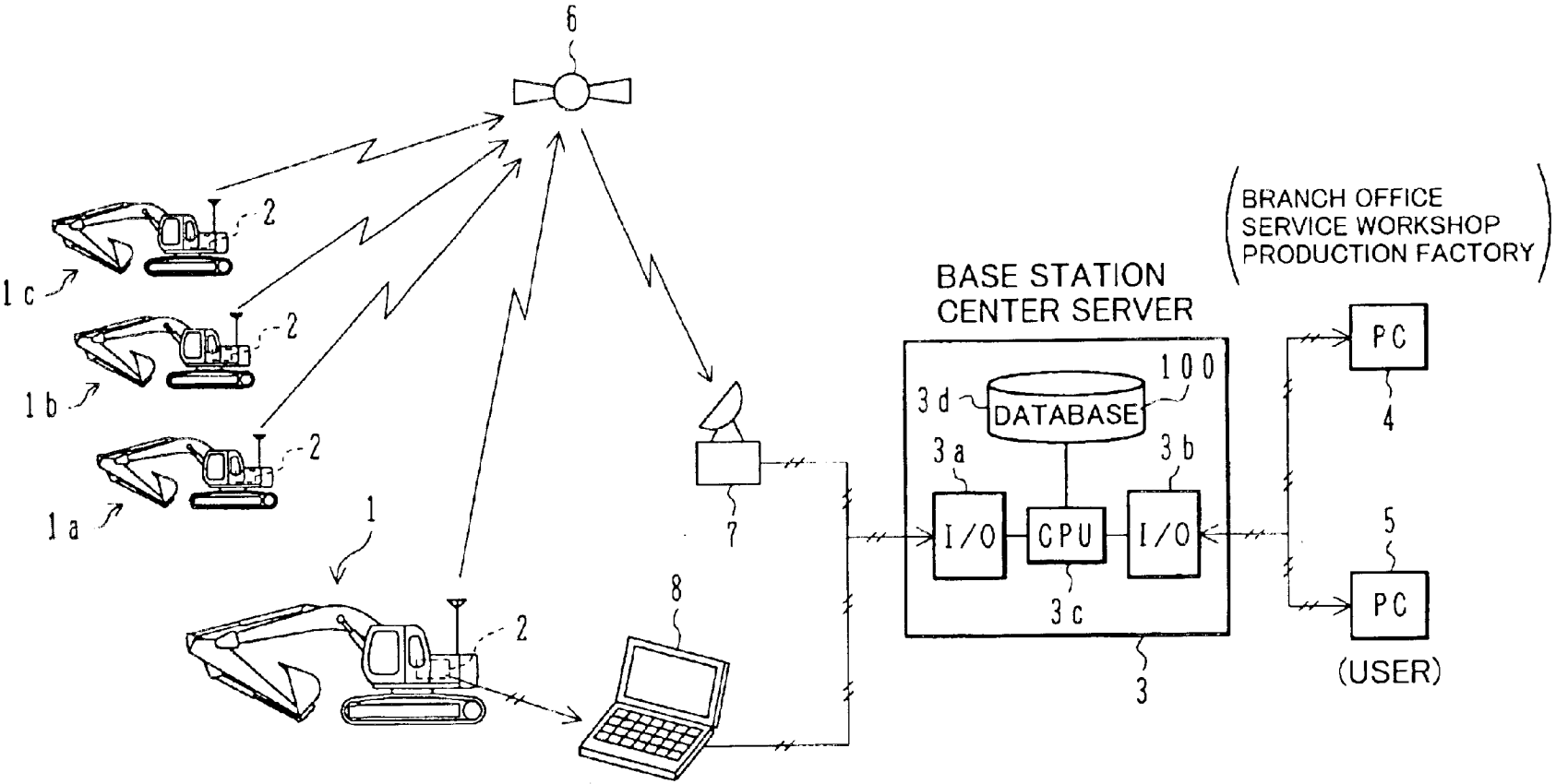
FIG. 1 shows an overall outline of a management system for a construction machine according to a first embodiment of the present invention.

FIG. 1 shows an overall outline of a management system for a construction machine according to a first embodiment of the present invention. The management system comprises machine side controllers 2 mounted on hydraulic excavators 1, 1*a*, 1*b*, 1*c*, . . . (hereinafter represented by numeral 1) working in fields; a base station center server 3 installed in a main office, a branch office, a production factory or the like; an in-house computer 4 installed in the branch office, a service workshop, the production factory or the like; and a user side computer 5. The base station center server 3 may be installed, in addition to the above-mentioned places, in any other desired place, for example, in a rental company possessing plural units of hydraulic excavators.

The controller 2 in each hydraulic excavator 1 collects operation information of the hydraulic excavator 1. The collected operation information is sent to a ground station 7 along with machine body information (machine model and number) via satellite communication using a communication satellite 6, and then transmitted from the ground station 7 to the base station center server 3. The machine body/operation information may be taken into the base station center server 3 through a personal computer 8 instead of satellite communication. In such a case, a serviceman downloads the operation information collected by the controller 2 into the personal computer 8 along with the machine body information (machine model and number). The downloaded information is taken into the base station center server 3 from the personal computer 8 using a floppy disk or via a communication line such as a public telephone line or the Internet. When using the personal computer 8, in addition to the machine body/operation information of the hydraulic excavator 1, check information obtained by the routine inspection and repair information can also be collected through manual inputting by the serviceman. Such manually inputted information is similarly taken into the base station center server 3.

Figure 2:
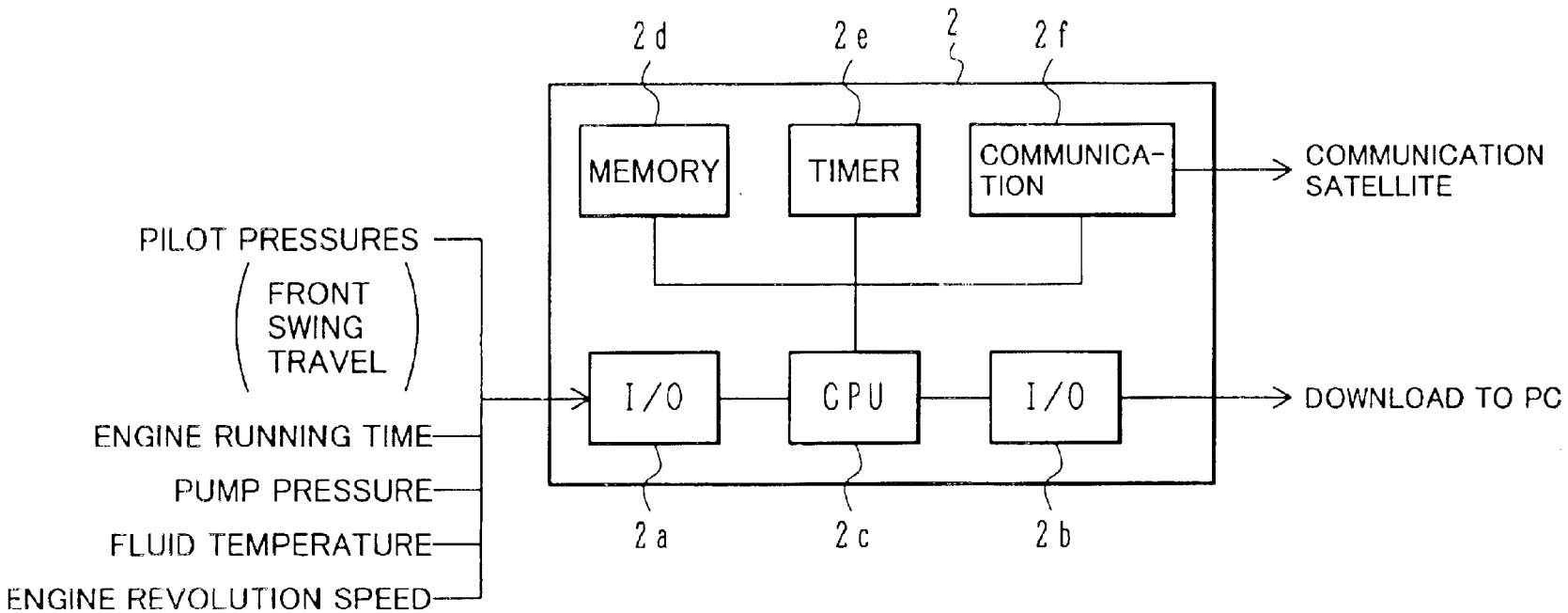
FIG. 2 shows details of the configuration of a machine side controller.

FIG. 2 shows details of the configuration of the machine side controller 2. In FIG. 2, the controller 2 comprises input/output interfaces 2*a*, 2*b*, a CPU (Central Processing Unit) 2*c*, a memory 2*d*, a timer 2*e*, and a communication control unit 2*f*.

The controller 2 receives, from a sensor group (described later) through the input/output interface 2*a*, detected signals of pilot pressures associated with the front, swing and travel; a detected signal of the running time (hereinafter referred to as the "engine running time") of an engine 32 (see FIG. 3); a detected signal of the pump pressure in a hydraulic system; a detected signal of the fluid temperature in the hydraulic system; and a detected signal of the engine revolution speed. The CPU 2*c* processes those data of the received information into operation information in the predetermined form by using the timer (including the clocking function) 2*e*, and then stores the operation information in the memory 2*d*. The communication control unit 2*f* routinely transmits the operation information to the base station center server 3 through satellite communication. Also, the operation information is downloaded into the personal computer 8 through the input/output interfaces 2*b*.

Additionally, the machine side controller 2 includes a ROM for storing control programs, with which the CPU 2*c* executes the above-described processing, and a RAM for temporarily storing data during the processing.

Figure 3:
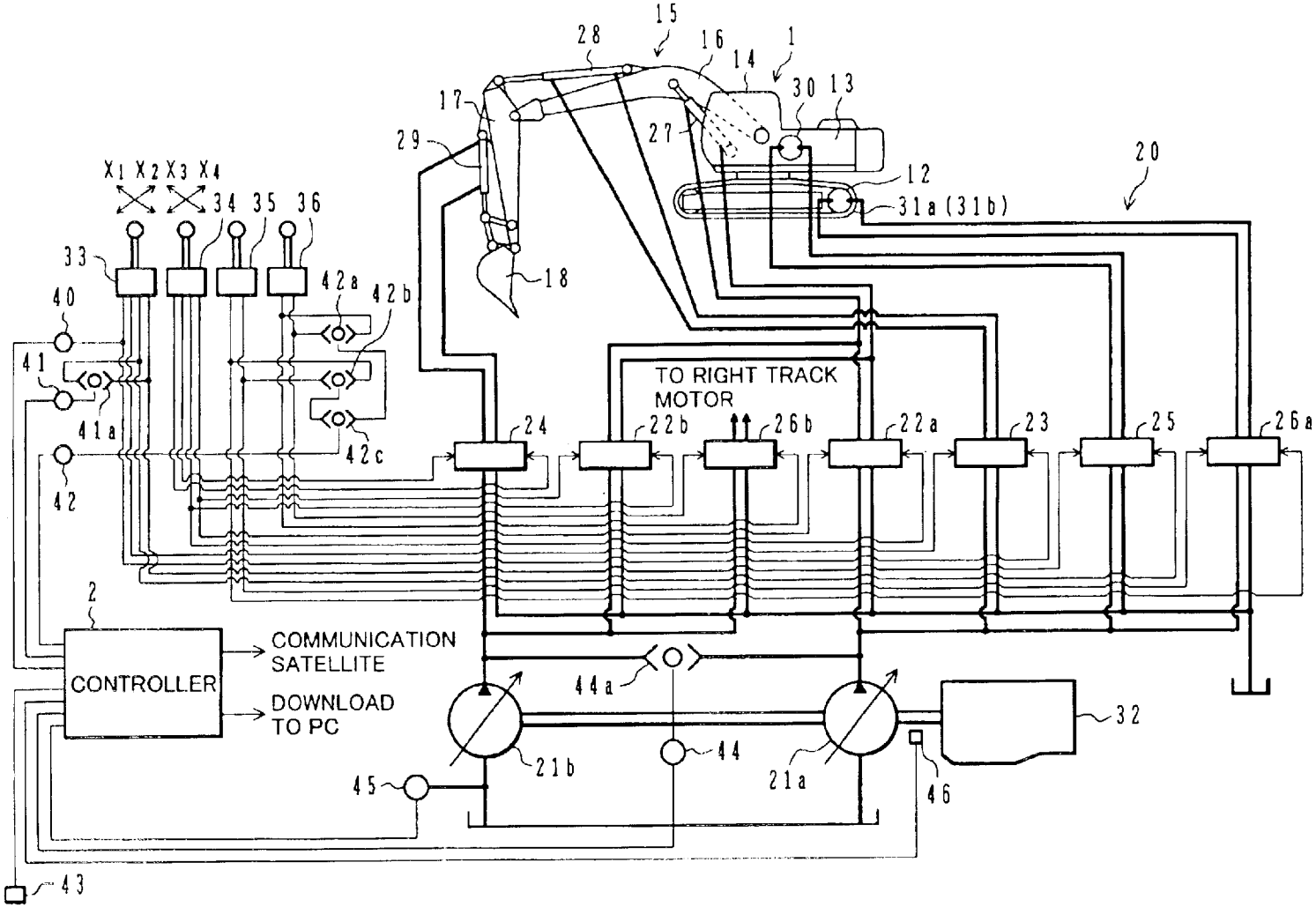
FIG. 3 shows details of a hydraulic excavator and a sensor group.

FIG. 3 shows details of the hydraulic excavator 1 and the sensor group. In FIG. 3, the hydraulic excavator 1 comprises a travel body 12; a swing body 13 rotatably mounted on the travel body 12; a cab 14 provided in a front left portion of the swing body 13; and an excavation device, i.e., a front 15, mounted to a front central portion of the swing body 13 in a vertically rotatable manner. The front 15 is made up of a boom 16 rotatably provided on the swing body 13; an arm 17 rotatably provided at a fore end of the boom 16; and a bucket 18 rotatably provided at a fore end of the arm 17.

Also, a hydraulic system 20 is mounted on the hydraulic excavator 1. The hydraulic system 20 comprises hydraulic pumps 21*a*, 21*b*; boom control valves 22*a*, 22*b*, an arm control valve 23, a bucket control valve 24, a swing control valve 25, and track control valves 26*a*, 26*b*; and a boom cylinder 27, an arm cylinder 28, a bucket cylinder 29, a swing motor 30, and track motors 31*a*, 31*b*. The hydraulic pumps 21*a*, 21*b* are driven for rotation by a diesel engine (hereinafter referred to simply as an "engine") 32 to deliver a hydraulic fluid. The control valves 22*a*, 22*b* to 26*a*, 26*b* control flows (flow rates and flow directions) of the hydraulic fluid supplied from the hydraulic pumps 21*a*, 21*b* to the actuators 27 to 31*a* and 31*b*. The actuators 27 to 31*a* and 31*b* drive the boom 16, the arm 17, the bucket 18, the swing body 13, and the travel body 12. The hydraulic pumps 21*a*, 21*b*, the control valves 22*a*, 22*b* to 26*a*, 26*b*, and the engine 32 are installed in an accommodation room formed in a rear portion of the swing body 13.

Control lever devices 33, 34, 35 and 36 are provided in association with the control valves 22*a*, 22*b* to 26*a*, 26*b*. When a control lever of the control lever device 33 is operated in one X1 of two cruciformly crossing directions, an arm-crowding pilot pressure or an arm-dumping pilot pressure is generated and applied to the arm control valve 23. When the control lever of the control lever device 33 is operated in the other X2 of the two cruciformly crossing directions, a rightward swing pilot pressure or a leftward swing pilot pressure is generated and applied to the swing control valve 25. When a control lever of the control lever device 34 is operated in one X3 of two cruciformly crossing directions, a boom-raising pilot pressure or a boom-lowering pilot pressure is generated and applied to the boom control valves 22*a*, 22*b*. When the control lever of the control lever device 34 is operated in the other X4 of the two cruciformly crossing directions, a bucket-crowding pilot pressure or a bucket-dumping pilot pressure is generated and applied to the bucket control valve 24. Further, when control levers of the control lever devices 35, 36 are operated, a left-track pilot pressure and a right-track pilot pressure are generated and applied to the track control valves 26*a*, 26*b*, respectively.

The control lever devices 33 to 36 are disposed in the cab 14 together with the controller 2.

Sensors 40 to 46 are provided in the hydraulic system 20 having the above-described construction. The sensor 40 is a pressure sensor for detecting the arm-crowding pilot pressure as an operation signal for the front 15. The sensor 41 is a pressure sensor for detecting the swing pilot pressure taken out through a shuttle valve 41*a*, and the sensor 42 is a pressure sensor for detecting the travel pilot pressure taken out through shuttle valves 42*a*, 42*b* and 42*c*. Also, the sensor 43 is a sensor for detecting the on/off state of a key switch of the engine 32, the sensor 44 is a pressure sensor for detecting the delivery pressure of the hydraulic pumps 21*a*, 21*b*, i.e., the pump pressure, taken out through a shuttle valve 44*a*, and the sensor 45 is a fluid temperature sensor for detecting the temperature of the working fluid (fluid temperature) in the hydraulic system 1. Further, the revolution speed of the engine 32 is detected by a revolution speed sensor 46. Signals from those sensors 40 to 46 are sent to the controller 2.

Returning to FIG. 1, the base station center server 3 comprises input/output interfaces 3*a*, 3*b*, a CPU 3*c*, and a storage device 3*d* in which a database 100 is formed. The input/output interface 3*a* receives the machine body/operation information and the check information from the machine side controller 2, and the input/output interface 3*b* receives part replacement information from the in-house computer 4. The CPU 3*c* stores and accumulates those data of the received information in the storage device 3*d* in the form of the database 100. Also, the CPU 3*c* processes the information stored in the database 100 to make a daily report, a maintenance report, a diagnostic report, etc., and then transmits those reports to the in-house computer 4 and the user side computer 5 via the input/output interface 3*b*.

Additionally, the base station center server 3 includes a ROM for storing control programs, with which the CPU 3*c* executes the above-described processing, and a RAM for temporarily storing data during the processing.

Figure 4:
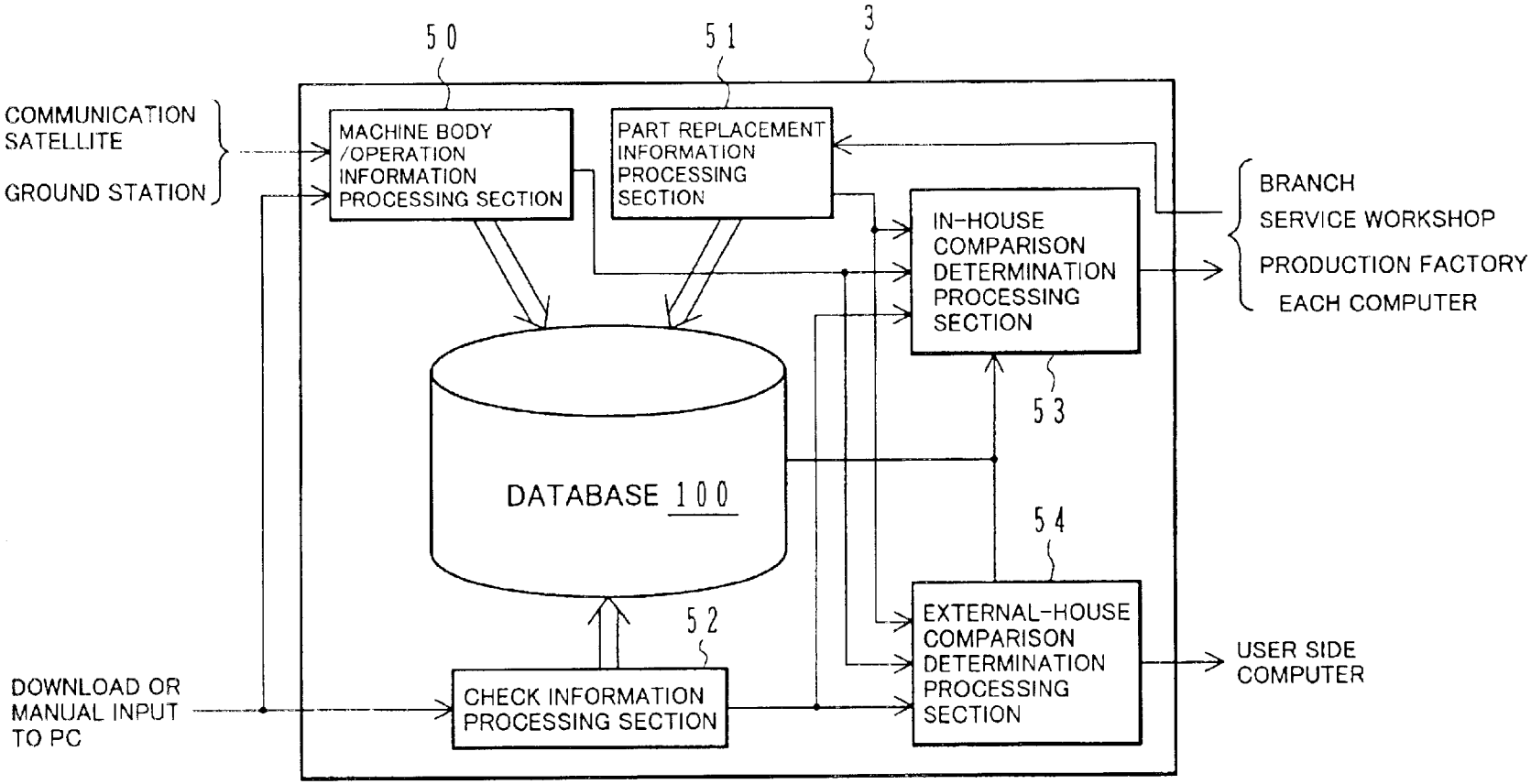
FIG. 4 is a functional block diagram showing an outline of processing functions of a CPU in a base station center server.

FIG. 4 is a functional block diagram showing an outline of processing functions of the CPU 3*c*. The CPU 3*c* has various processing functions executed by a machine body/operation information processing section 50, a part replacement information processing section 51, a check information processing section 52, an in-house comparison determination processing section 53, and an external-house comparison determination processing section 54. The machine body/operation information processing section 50 executes predetermined processing based on the operation information inputted from the machine side controller 2. The part replacement information processing section 51 executes predetermined processing based on part replacement information inputted from the in-house computer 4 (as described later). The check information processing section 52 stores and accumulates the check information, inputted from the personal computer 8, in the database 100, and also processes the check information to make a diagnostic report. The in-house comparison determination processing section 53 and the external-house comparison determination processing section 54 select required data among from not only the information prepared by the machine body/operation information processing section 50, the part replacement information processing section 51 and the check information processing section 52, but also the information stored and accumulated in the database 100, and then transmit the selected data to the in-house computer 4 and the user side computer 5.

The processing functions of the machine side controller 2 and the processing functions of the machine body/operation information processing section 50 and the part replacement information processing section 51 in the base station center server 3 will be described below with reference to flowcharts.

The processing functions of the machine side controller 2 are primarily divided into the function of collecting the working time for each section of the hydraulic excavator, the function of collecting frequency distribution data such as a load frequency distribution, and the function of collecting warning data. Correspondingly, the machine body/operation information processing section 50 of the base station center server 3 has the function of processing the working time, the function of processing the frequency distribution data, and the function of processing the warning data. Also, the part replacement information processing section 51 has the function of processing the part replacement information.

A description is first made of the function of collecting the working time for each section of the hydraulic excavator, which is executed in the machine side controller 2.

Figure 5:
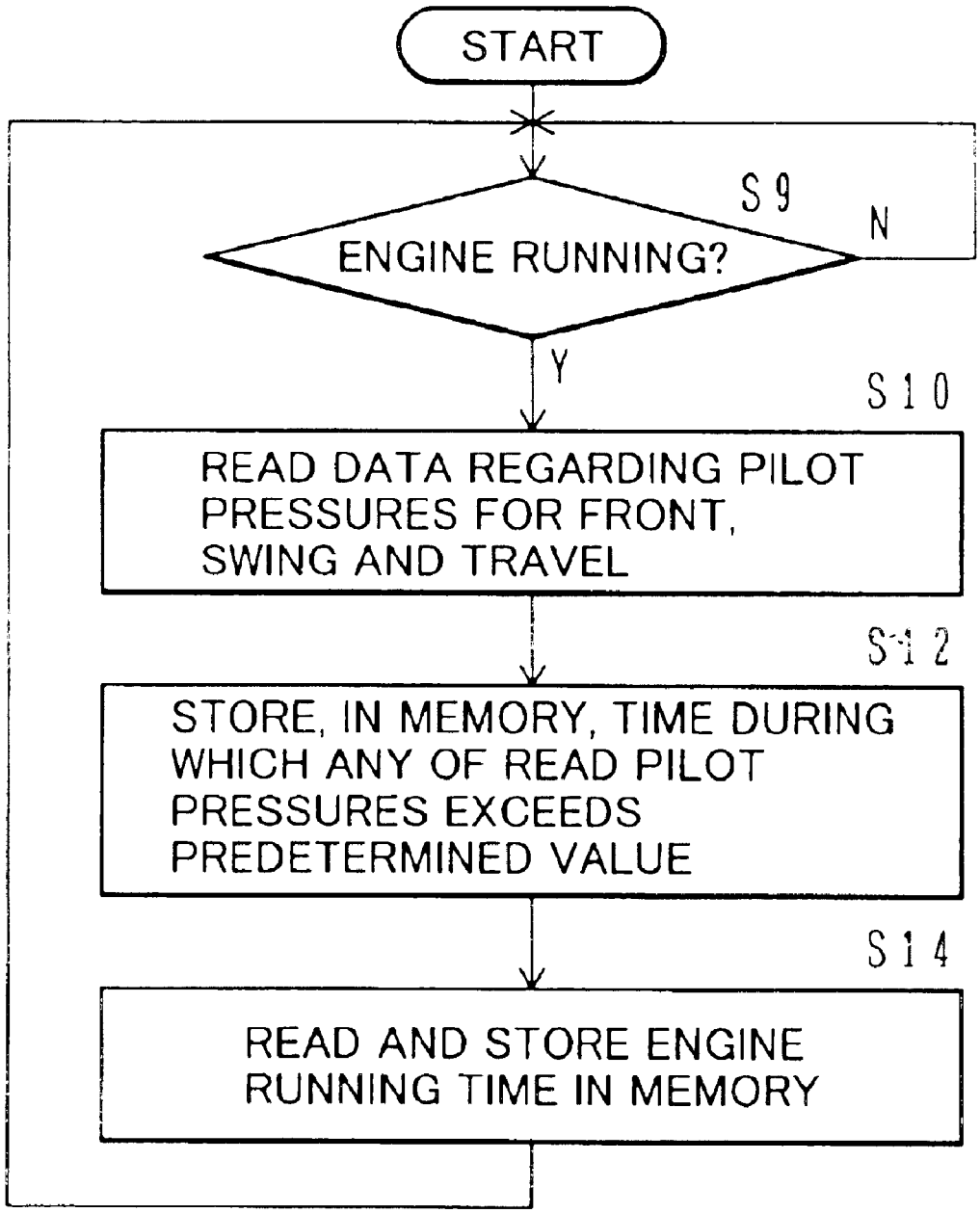
FIG. 5 is a flowchart showing the function of collecting a working time for each section of the hydraulic excavator in a CPU of the machine side controller.
Figure 6:
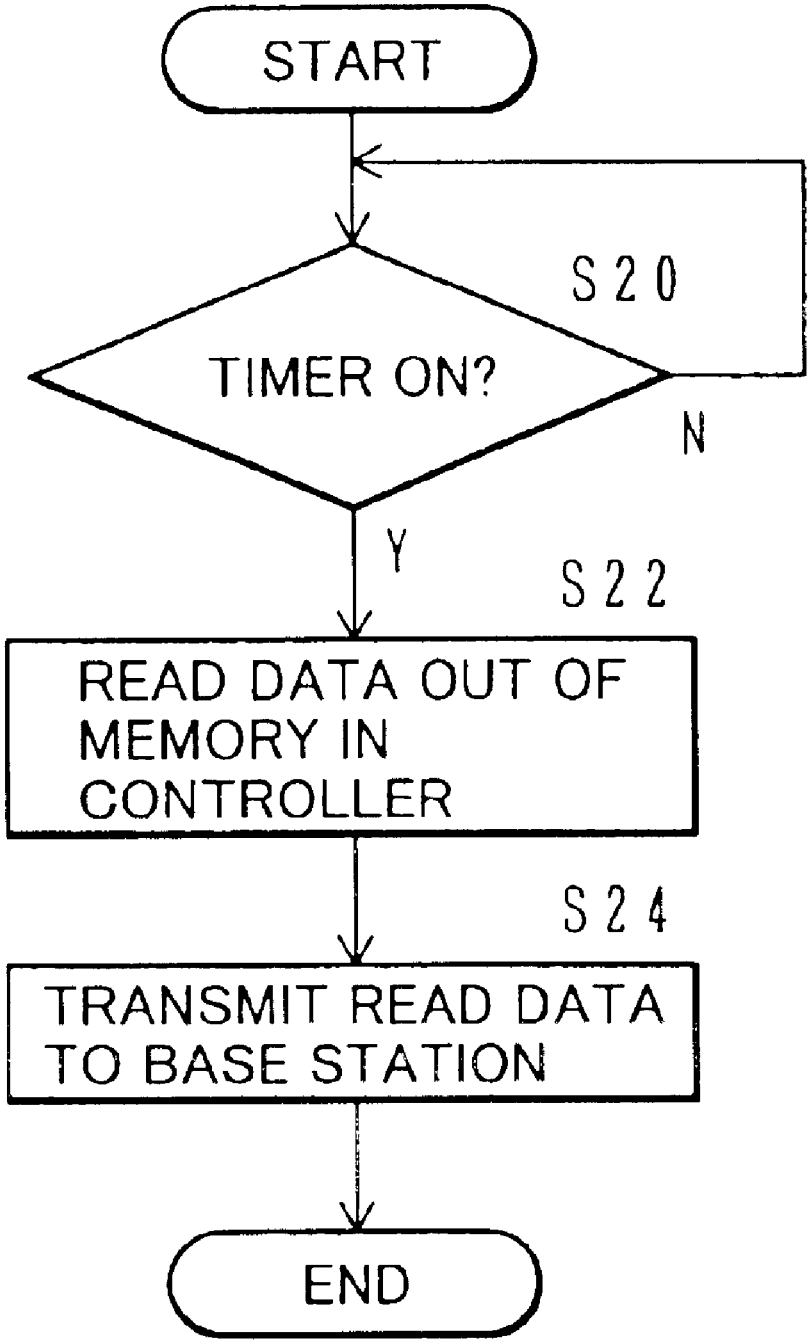
FIG. 6 is a flowchart showing the processing function of a communication control unit in the machine side controller executed when the collected working time data is transmitted.

FIG. 5 is a flowchart showing the function of collecting the working time for each section of the hydraulic excavator, which is executed in the CPU 2*c* of the controller 2, and FIG. 6 is a flowchart showing the processing function of the communication control unit 2*f* in the controller 2 executed when the collected working time data for each section is transmitted.

In FIG. 5, the CPU 2*c* first determines whether the engine revolution speed signal from the sensor 46 is a value not lower than a predetermined revolution speed, and hence whether the engine is running (step S9). If it is determined that the engine is not running, the step S9 is repeated. If it is determined that the engine is running, the CPU 2*c* proceeds to next step S10 and reads data regarding the detected signals of the pilot pressures associated with the front, swing and travel from the sensors 40, 41 and 42 (step S10). Then, for each of the read pilot pressures associated with the front, swing and travel, the CPU 2*c* calculates, using time information from the timer 2*e*, a time during which the pilot pressure exceeds a predetermined pressure, and stores and accumulates the calculated result in the memory 2*d* in correspondence to the date and the time of day (step S12). Herein, the predetermined pressure represents a pilot pressure, which can be regarded as indicating that corresponding one of the front, swing and travel operations has been performed. Also, while it is determined in the step S9 that the engine is running, the CPU 2*c* calculates the engine running time using the time information from the timer 2*e*, and stores and accumulates the calculated result in the memory 2*d* in correspondence to the date and the time of day (step S14). The CPU 2*c* executes the above-described processing at a predetermined cycle during a period of time in which power supplied to the controller 2 is kept turned on.

The steps S12, S14 may be modified such that each value of the calculated working time may be added to the corresponding time that has been calculated in the past and stored in the memory 2*d*, and may be stored as a cumulative working time.

In FIG. 6, the communication control unit 2*f* monitors whether the timer 2*e* is turned on (step S20). When the timer 2*e* is turned on, the communication control unit 2*f* reads the working time for each of the front, swing and travel, the engine running time (including the date and the time of day), and the machine body information, which are stored and accumulated in the memory 2*d* (step S22). The read data is then transmitted to the base station center server 3 (step S24). The timer 2*e* is set to turn on at the fixed time of day, for example, at a.m. 0. By so setting the timer, when it becomes a.m. 0, the working time data for one preceding day is transmitted to the base station center server 3.

The CPU 2*c* and the communication control unit 2*f* repeat the above-described processing everyday. The data stored in the CPU 2*c* is erased when a predetermined number of days, e.g., 365 days (one year), have lased after the transmission to the base station center server 3.

Figure 7:
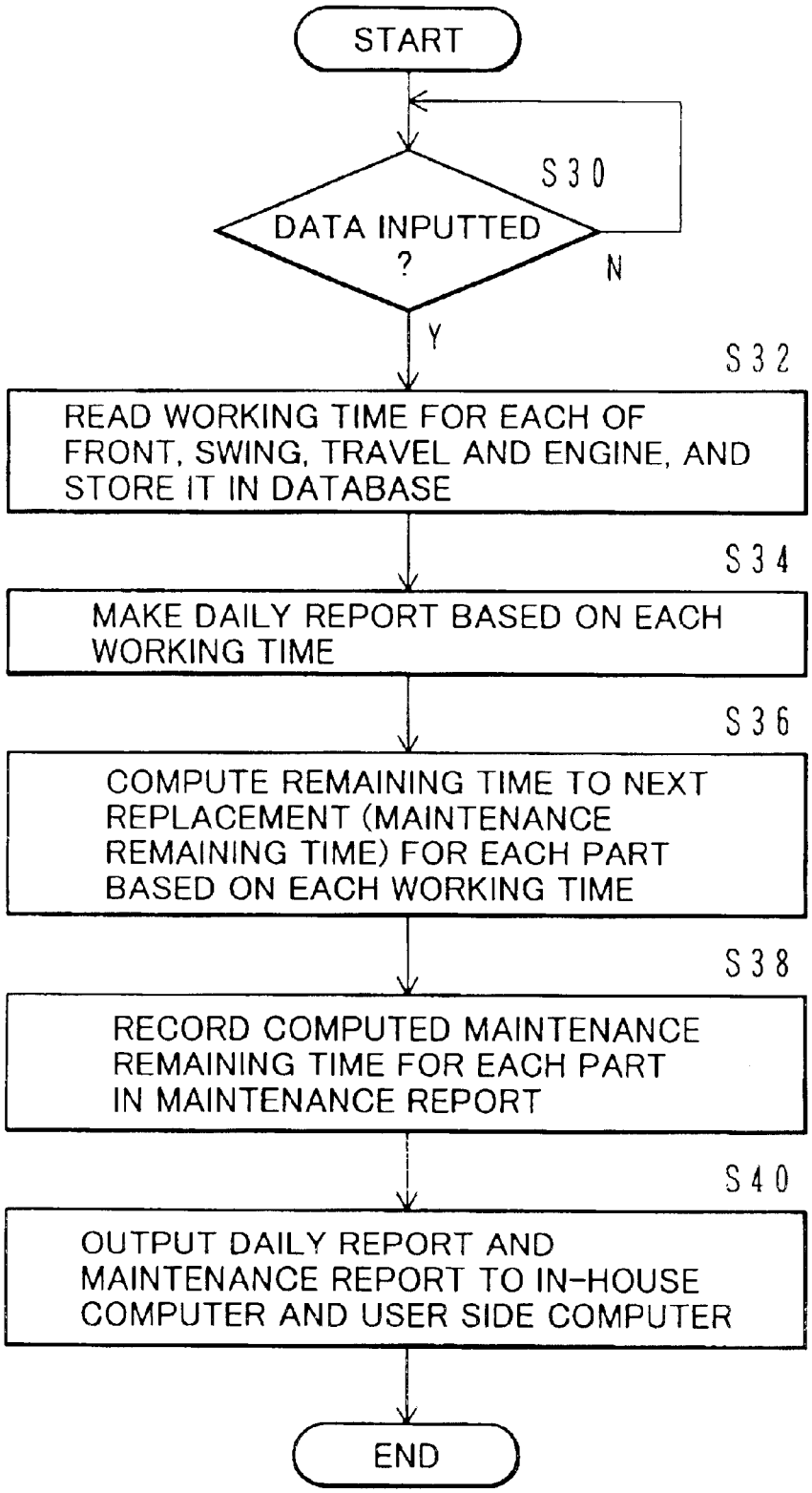
FIG. 7 is a flowchart showing the processing function of a machine body/operation information processing section of the base station center server executed when the working time data has been transmitted from the machine side controller.

FIG. 7 is a flowchart showing the processing function of the machine body/operation information processing section 50 in the center server 3 executed when the machine body/operation information has been transmitted from the machine side controller 2.

In FIG. 7, the machine body/operation information processing section 50 monitors whether the machine body/operation information is inputted from the machine side controller 2 (step S30). When the machine body/operation information is inputted, the processing section 50 reads the inputted information, and then stores and accumulates it as operation data (described later) in the database 100 (step S32). The machine body information contains, as described above, the machine model and number. Subsequently, the processing section 50 reads the operation data for a predetermined number of days, e.g., one month, out of the database 100 and makes a daily report regarding the working time (step S34). Also, the processing section 50 reads, out of the database 100, the operation data, actual maintenance data (described later) and target maintenance data (described later), computes the remaining time up to next replacement (hereinafter referred to as the "maintenance remaining time") for each part on the basis of the working time per section to which the relevant part belongs (step S36), and then records the computed results in the maintenance report (step S38). Thereafter, the daily report and the maintenance report thus prepared are transmitted to the in-house computer 4 and the user side computer 5 (step S40).

Figure 8:
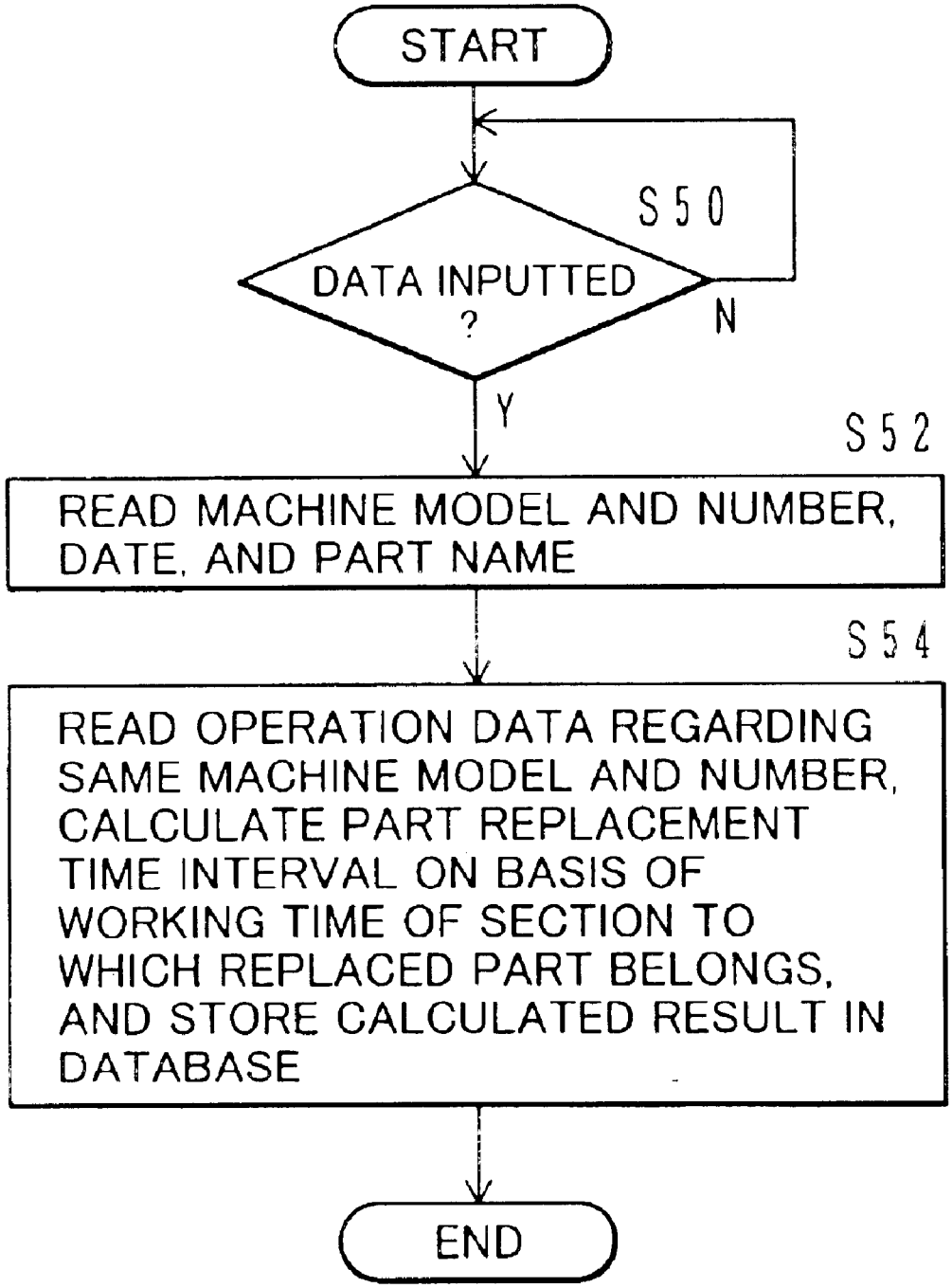
FIG. 8 is a flowchart showing the function of processing part replacement information executed in a part replacement information processing section of the base station center server.

FIG. 8 is a flowchart showing the function of processing the part replacement information in the part replacement information processing section 51 of the center server 3.

In FIG. 8, the part replacement information processing section 51 monitors whether the part replacement information is inputted from the in-house computer 4 by, e.g., the serviceman (step S50). When the part replacement information is inputted, the processing section 51 reads the inputted information (step S52). Herein, the part replacement information contains the machine model and number of a hydraulic excavator whose part has been replaced, the replacement date, and the name of the replaced part.

Then, the processing section 51 accesses the database 100, reads the operation data regarding the same machine number, and calculates a replacement time interval of each replaced part on the basis of the working time of the section to which the replaced part belongs, followed by storing and accumulating the calculated result in the database 100 as actual maintenance data per machine model (step S54). Herein, the part replacement time interval means a time interval from the time at which one part was assembled in the machine body, to the time at which it was replaced by a new one because of a failure or expiration of the life. As mentioned above, the part replacement time interval is calculated on the basis of the working time of the section to which the replaced part belongs. Taking the bucket prong as an example, the section to which the bucket prong belongs is the front. Then, if the front operating time (excavation time) measured from assembly of one bucket prong in the machine body to replacement by another because of breakage is 1500 hours, the replacement time interval of the bucket prong is calculated as 1500 hours.

FIG. 9 shows how the operation data, the actual maintenance data, and the target maintenance data are stored in the database 100.

In FIG. 9, the database 100 contains various sections, i.e., a database section (hereinafter referred to as an "operation database") in which the operation data per machine model and number is stored and accumulated, a database section (hereinafter referred to as an "actual maintenance database") in which the actual maintenance data per machine model and number is stored and accumulated, and a database section (hereinafter referred to as a "target maintenance database") in which the target maintenance data per machine model is stored and accumulated. Those databases store data as follows.

In the operation database per machine model and number, the engine running time, the front operating time (hereinafter referred to also as the "excavation time"), the swing time, and the travel time are stored per machine model and number as cumulative values in correspondence to the date. In an illustrated example, $T_{NE}(1)$ and $T_D(1)$ represent respective cumulative values of the engine running time and the front operating time for a No. N machine of model A as of Jan. 1, 2000. $T_{NE}(K)$ and $T_D(K)$ represent respective cumulative values of the engine running time and the front operating time for the No. N machine of model A as of Mar. 16, 2000. Similarly, cumulative values $T_S(1)$ to $T_S(K)$ of the swing time and cumulative values $T_T(1)$ to $T_T(K)$ of the travel time for the No. N machine of model A are stored in correspondence to the date. Similar data is also stored for a No. N+1 machine, a No. N+2 machine, . . . of model A.

Note that the operation database shown in FIG. 9 indicates only a part of the operation data (corresponding to daily report data), and the frequency distribution data is also additionally stored in the operation database (as described later with reference to FIG. 24).

In the actual maintenance database per machine model and number, the replacement time intervals of parts, which have been replaced in the past, are each stored per machine model and number as a cumulative value on the basis of the working time of the section to which the relevant part belongs. In an illustrated example, $T_{EF}(1)$ and $T_{EF}(L)$ represent respective cumulative values of the replacement time intervals after the first and L-th replacement of the engine oil filters of the No. N machine of model A (e.g., 3400 hr and 12500 hr on the basis of the engine running time). $T_{FB}(L)$ and $T_{FB}(M)$ represent respective cumulative values of the replacement time intervals after the first and M-th replacement of the front bushings of the No. N machine (e.g., 5100 hr and 14900 hr on the basis of the front operating time). Similar data is also stored for a No. N+1 machine, a No. N+2 machine, . . . of model A.

In the target maintenance database per machine model, the target replacement time interval for each of parts used in each machine model is stored per machine model as a value on the basis of the working time of the section to which the relevant part belongs. In an illustrated example, $T_{M\text{-}EF}$ represents the target replacement time interval of the engine oil filter used in the machine model A (e.g., 4000 hr on the basis of the engine running time). $T_{M\text{-}FB}$ represents the target replacement time interval of the front bushing used in the machine model A (e.g., 5000 hr on the basis of the front operating time). Similar data is also stored for all other machine models B, C, . . . .

Figure 10:
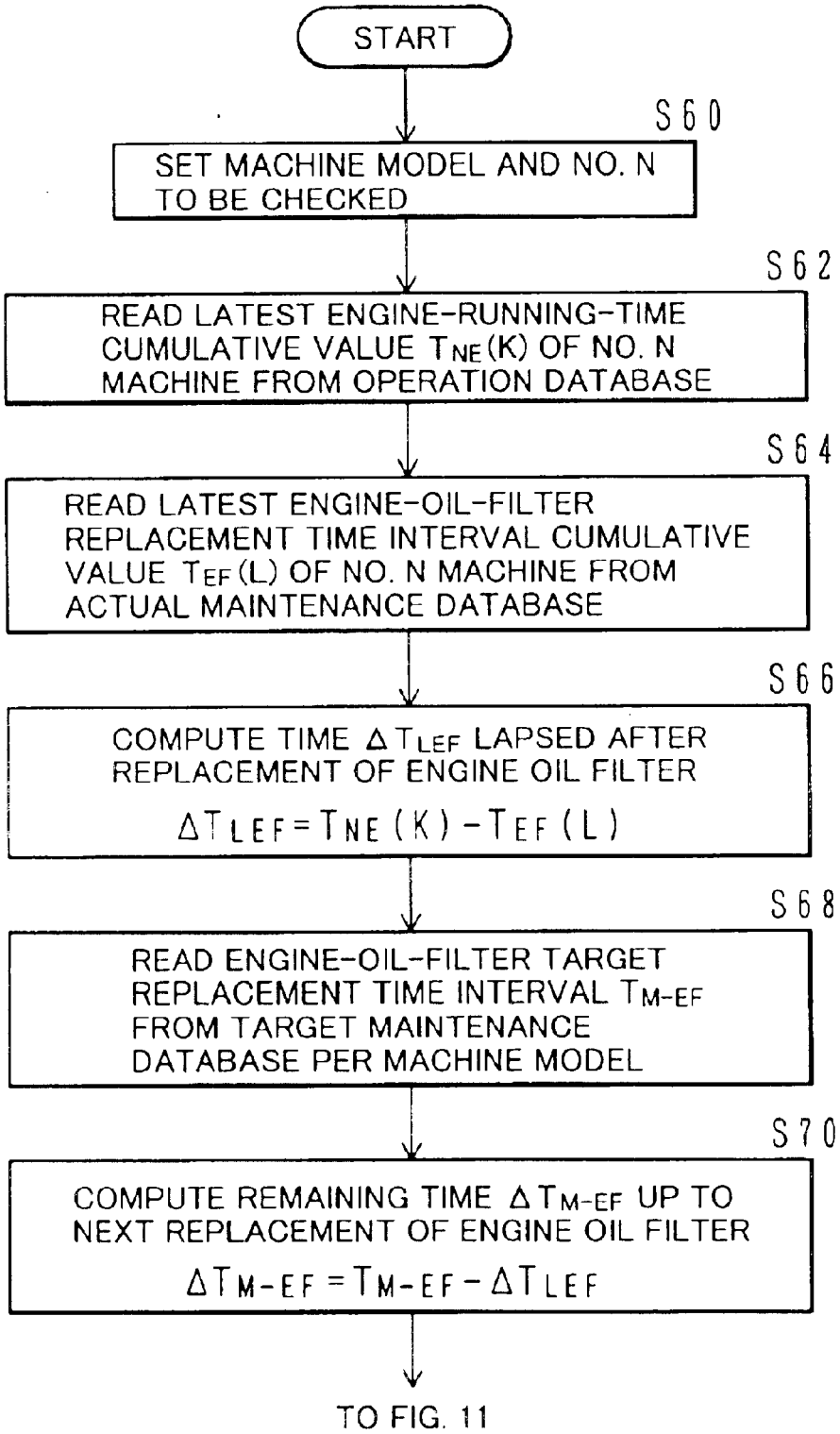
FIG. 10 is a flowchart showing a manner of calculating the maintenance remaining time.
Figure 11:
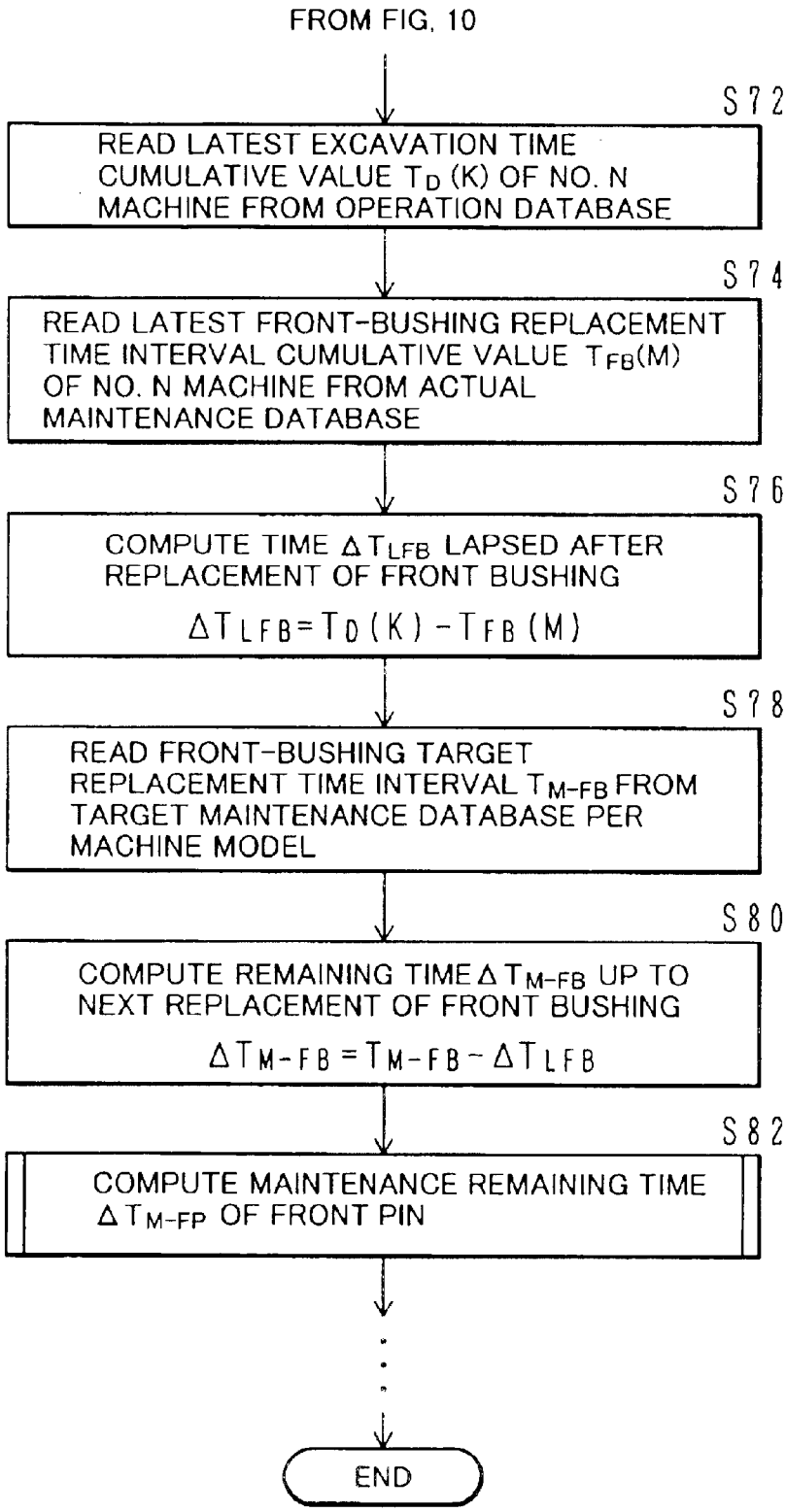
FIG. 11 is a flowchart showing a manner of calculating the maintenance remaining time.

Using the data stored in the operation database, the actual maintenance database and the target maintenance database described above, the machine body/operation information processing section 50 computes, in the step S36 of FIG. 7, the maintenance remaining time for each part on the basis of the working time per section, to which the relevant part belongs, in accordance with procedures shown in flowcharts of FIGS. 10 and 11.

In this embodiment, the term "working time per section to which the relevant part belongs" represents the operating time of the front 15 (excavation time) when the front 15 is the section to which the relevant part belongs, as with the bucket prong, the front pin (e.g., the joint pin between the boom and the arm), the bushing around the front pin, the arm, the bucket, etc., the swing time when the swing body 13 is the section to which the relevant part belongs, as with the swing transmission oil, the swing transmission seal, the swing wheel, etc., and the travel time when the travel body 12 is the section to which the relevant part belongs, as with the track transmission oil, the track transmission seal, the track shoe, the track roller, the track motor, etc. The above term also represents the engine running time when the engine 32 is the section to which the relevant part belongs, as with the engine oil, the engine oil filter, etc. Further, when a hydraulic source of the hydraulic system is the section to which the relevant part belongs, as with the working fluid, a working fluid filter, a pump bearing, etc., the engine running time is regarded as the working time of the section to which those parts belong. Note that the operating time of the hydraulic source (i.e., the working time of each of the parts such as the working fluid, the working fluid filter and the pump bearing) may be obtained by detecting the working time during which the delivery pressure of the hydraulic pumps 21*a*, 21*b* is not lower than a predetermined level, or by subtracting a period of time, during which no load is applied, from the engine running time.

Referring to FIGS. 10 and 11, the machine body/operation information processing section 50 first sets the machine model and number (e.g., N) of the hydraulic excavator to be checked (step S60). Then, the processing section 50 reads the latest engine-running-time cumulative value $T_{NE}(K)$ of the No. N machine of the set model from the operation database (step S62). Also, it reads the latest engine-oil-filter replacement time interval cumulative value $T_{EF}(L)$ of the No. N machine of the set model from the actual maintenance database (step S64). Thereafter, a time $\Delta T_{LEF}$ lapsed after the last replacement of the engine oil filter is computed from the following formula (step S66):

$$\Delta T_{LEF}=T_{NE}(K)-T_{EF}(L)$$

The lapsed time $\Delta T_{LEF}$ corresponds to the working time of the engine oil filter up to now, which is currently in use.

Further, the processing section 50 reads the engine-oil-filter target replacement time interval $T_{M\text{-}EF}$ from the target maintenance database per machine model (step S68). Then, the remaining time $\Delta T_{M\text{-}EF}$ up to next replacement of the engine oil filter is computed from the following formula (step S70):

$$\Delta T_{M\text{-}EF}=T_{M\text{-}EF}-\Delta T_{LEF}$$

As a result, the remaining time up to next replacement of the engine oil filter in the No. N machine of the set model is computed as $\Delta T_{M\text{-}EF}$.

Next, the processing section 50 reads the latest front-operating-time (excavation time) cumulative value $T_D(K)$ of the No. N machine of the set model from the operation database (step S72 in FIG. 11). Also, it reads the latest front-bushing replacement time interval cumulative value $T_{FB}(M)$ of the No. N machine of the set model from the actual maintenance database (step S74). Then, a time $\Delta T_{LFB}$ lapsed after the last replacement of the front bushing is computed from the following formula (step S76):

$$\Delta T_{LFB}=T_D(K)-T_{FB}(M)$$

The lapsed time $\Delta T_{LFB}$ corresponds to the working time of the front bushing up to now, which is currently in use.

Further, the processing section 50 reads the front-bushing target replacement time interval $T_{M\text{-}FB}$ from the target maintenance database per machine model (step S78). Thereafter, the remaining time $\Delta T_{M\text{-}FB}$ up to next replacement of the front bushing is computed from the following formula (step S80):

$$\Delta T_{M\text{-}FB}=T_{M\text{-}FB}-\Delta T_{LFB}$$

As a result, the remaining time up to next maintenance of the front bushing in the No. N machine of the set model is computed as $\Delta T_{M\text{-}FB}$.

The maintenance remaining time is similarly calculated for other parts, e.g., the front pin (step S82).

Figure 12:
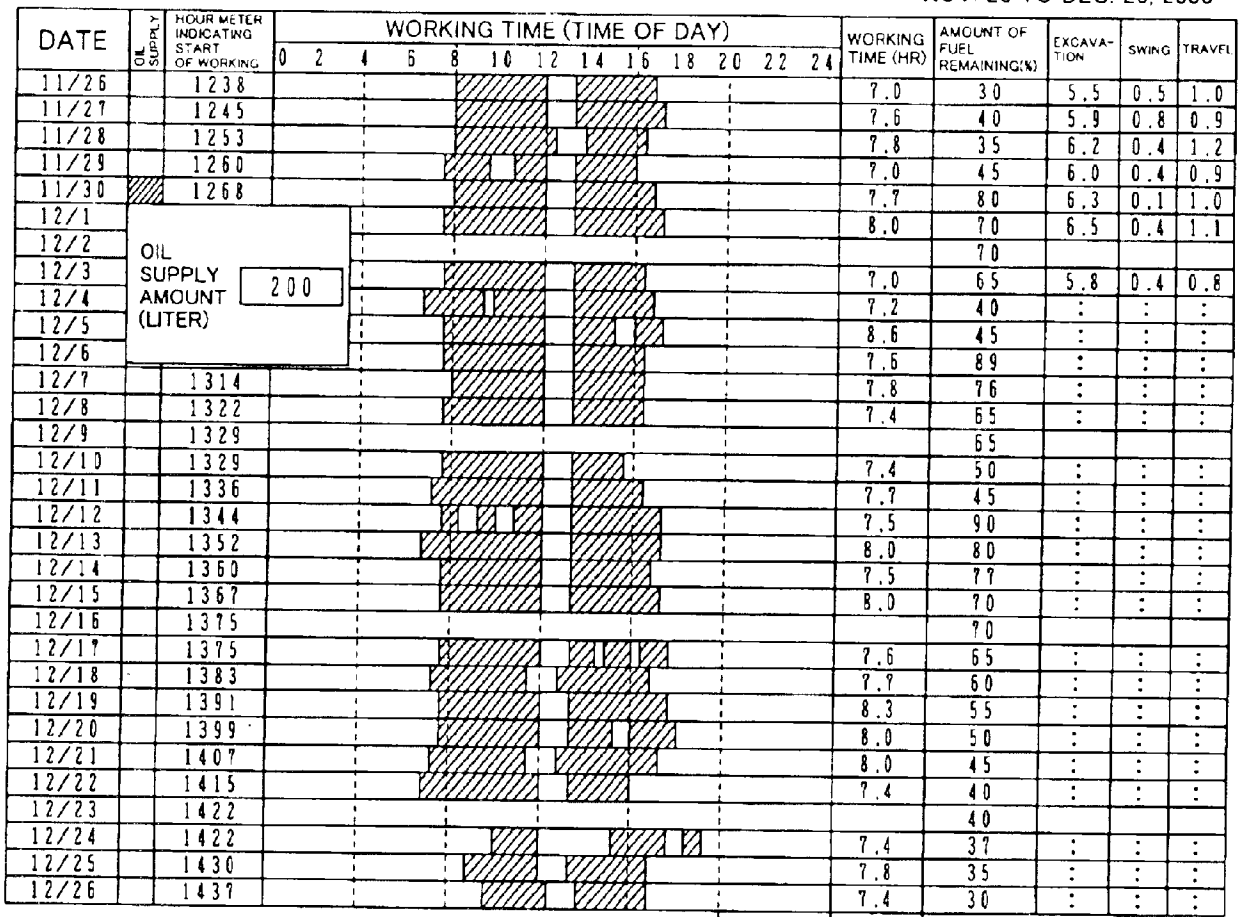
FIG. 12 is a table showing one example of a daily report transmitted to an in-house computer and a user side computer.
Figure 13:
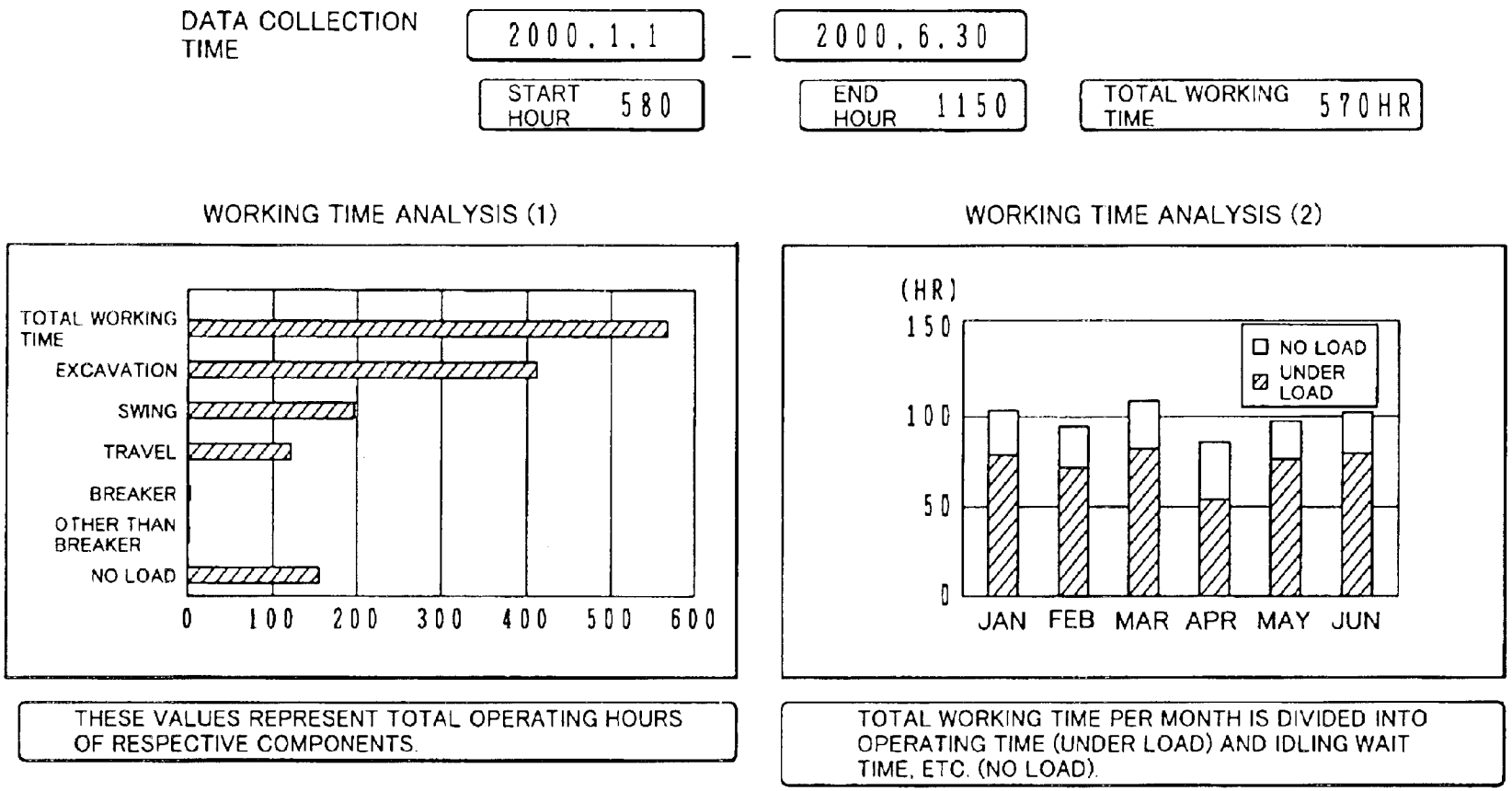
FIG. 13 is a table showing one example of a daily report transmitted to the in-house computer and the user side computer.

FIGS. 12 and 13 each show one example of the daily report transmitted to the in-house computer 4 and the user side computer 5. FIG. 12 shows each item of working time data for one month in the form of a graph and numerical values in correspondence to the date. Based on FIG. 12, the user can confirm changes of situations in use of the owned hydraulic excavator for the past one month. The left side of FIG. 13 graphically shows the working time for each section and the engine running time under no load for the past half year, and the right side of FIG. 13 graphically shows transition of a ratio between the engine running time under load and the engine running time under no load for the past half year. Based on FIG. 13, the user can confirm changes of situations and efficiency in use of the owned hydraulic excavator for the past half year.

Figure 14:
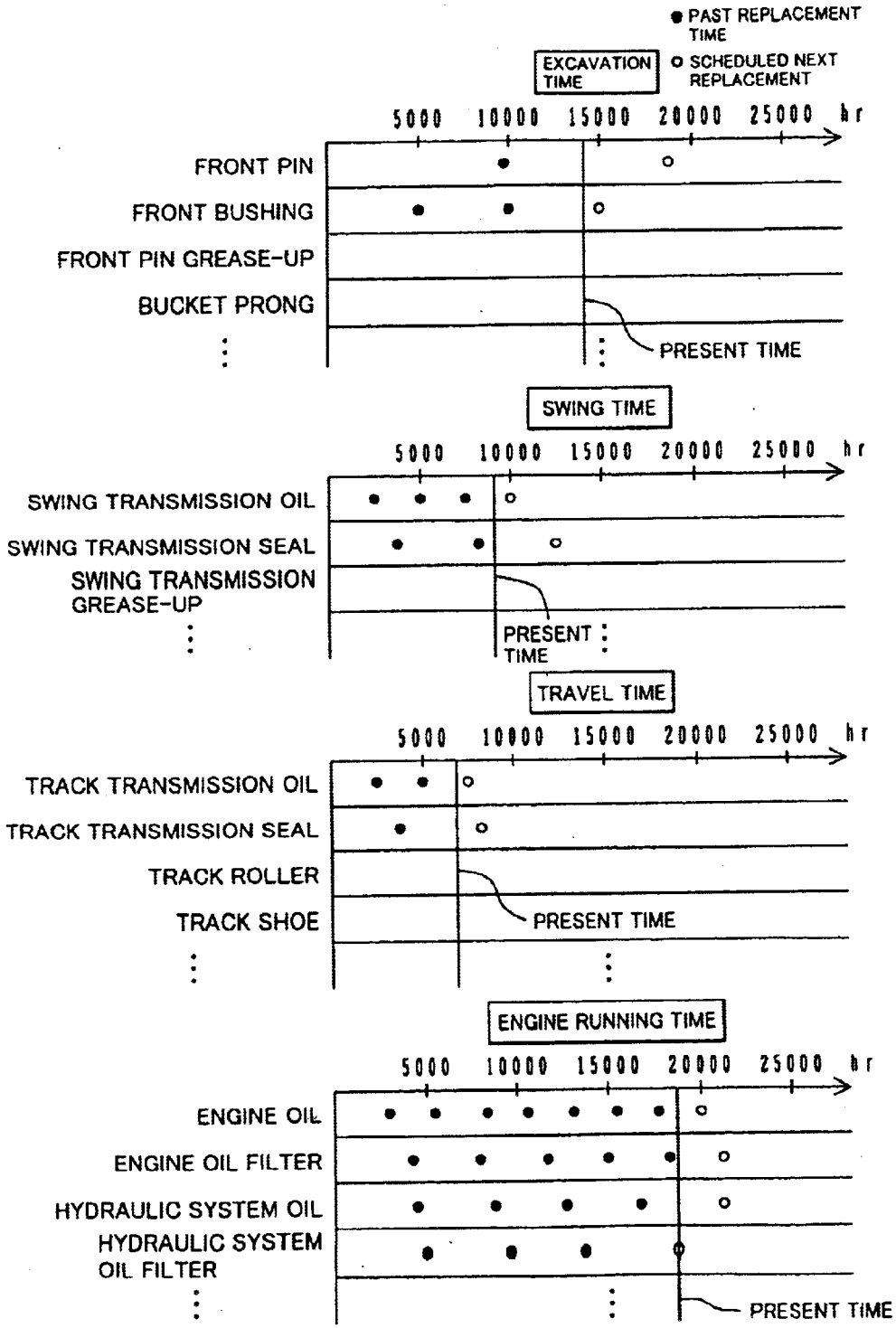
FIG. 14 shows one example of a maintenance report transmitted to the in-house computer and the user side computer.

FIG. 14 shows one example of the maintenance report transmitted to the in-house computer 4 and the user side computer 5. A chart in the first stage counting from the top represents maintenance information of the parts indicated on the basis of the front operating time (excavation time), and a chart in the second stage represents maintenance information of the parts indicated on the basis of the swing time. A chart in the third stage represents maintenance information of the parts indicated on the basis of the travel time, and a chart in the fourth stage represents maintenance information of the parts indicated on the basis of the engine running time. In each of the charts, a mark=indicates the past replacement time, and a mark O indicates the next scheduled replacement time. Also, a straight line drawn between the mark=and the mark O indicates the present time. A distance between the straight line and the mark O represents the maintenance remaining time. As a matter of course, the remaining time may be indicated as a numerical value. Also, while the remaining time represents a value on the basis of the working time per section, the remaining time may be indicated as the date by determining an average value of each working time per day and calculating the number of days corresponding to the remaining time. Alternatively, the day of scheduled replacement may be indicated by adding the calculated number of days to the present date.

Figure 15:
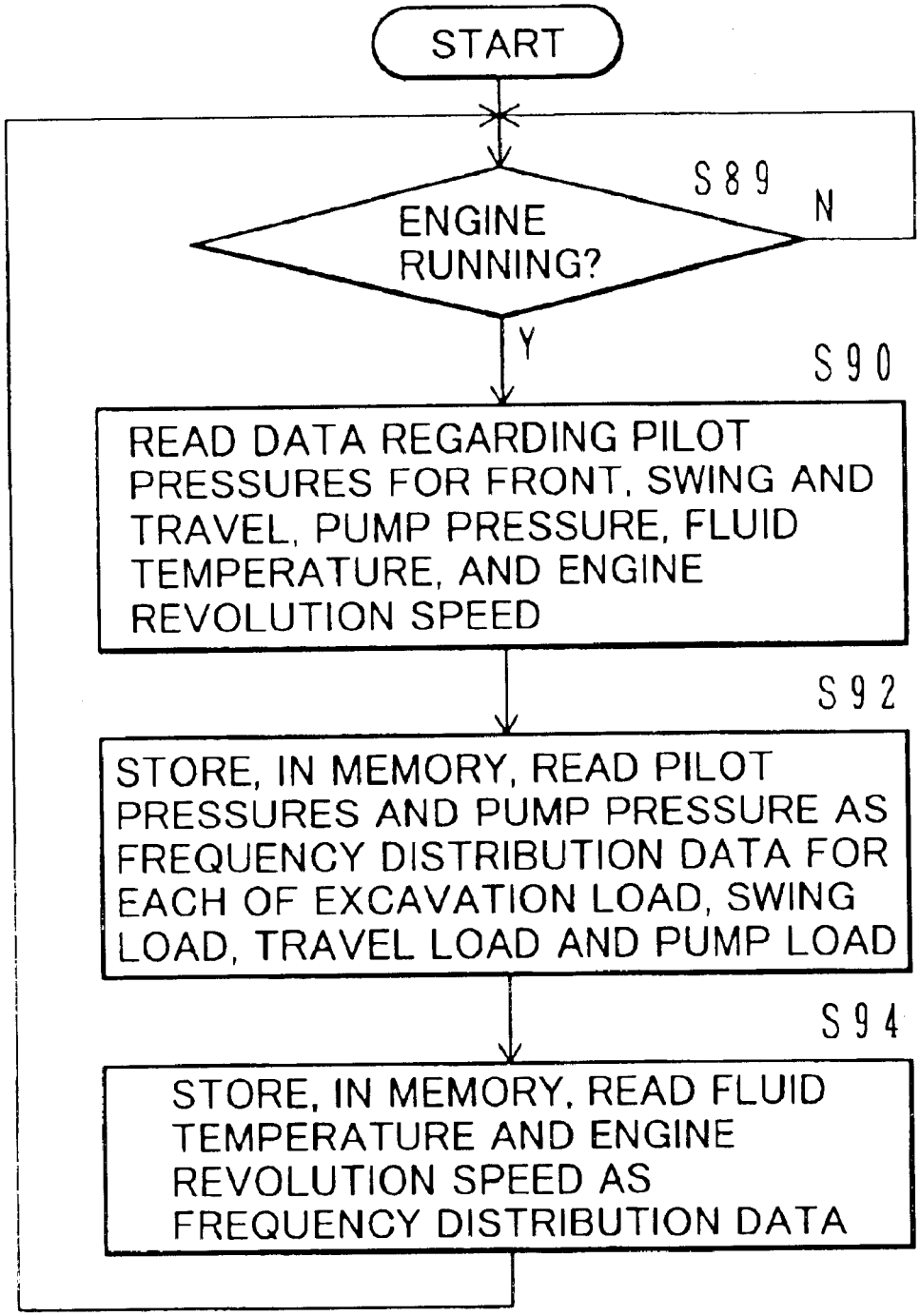
FIG. 15 is a flowchart showing the function of collecting frequency distribution data in the machine side controller.

The function of collecting the frequency distribution data in the machine side controller 2 will be described below with reference to FIG. 15. FIG. 15 is a flowchart showing the processing function of the CPU 2*c* in the controller 2.

In FIG. 15, the CPU 2*c* first determines whether the engine revolution speed signal from the sensor 46 is a value not lower than a predetermined revolution speed, and hence whether the engine is running (step S89). If it is determined that the engine is not running, the step S89 is repeated. If it is determined that the engine is running, the CPU 2*c* proceeds to next step S90 and reads data regarding the detected signals of the pilot pressures associated with the front, swing and travel from the sensors 40, 41 and 42, the detected signal of the pump pressure from the sensor 44, the detected signal of the fluid temperature from the sensor 45, and the detected signal of the engine revolution speed from the sensor 46 (step S90). Then, of the read data, the respective pilot pressures associated with the front, swing and travel, as well as the pump pressure are stored in the memory 2*d* as the frequency distribution data of excavation loads, swing loads, travel loads, and pump loads (step S92). Further, the read fluid temperature and engine revolution speed are also stored in the memory 3*d* as the frequency distribution data (step S94).

While the engine is running, the steps S90 to S94 are repeated.

Herein, the frequency distribution data means data representing a distribution of respective detected values per predetermined time, e.g., 100 hours, with the pump pressure or the engine revolution speed being a parameter. The predetermined time (100 hours) is a value on the basis of the engine running time. Incidentally, the predetermined time may be a value on the basis of the working time for each section.

Figure 16:
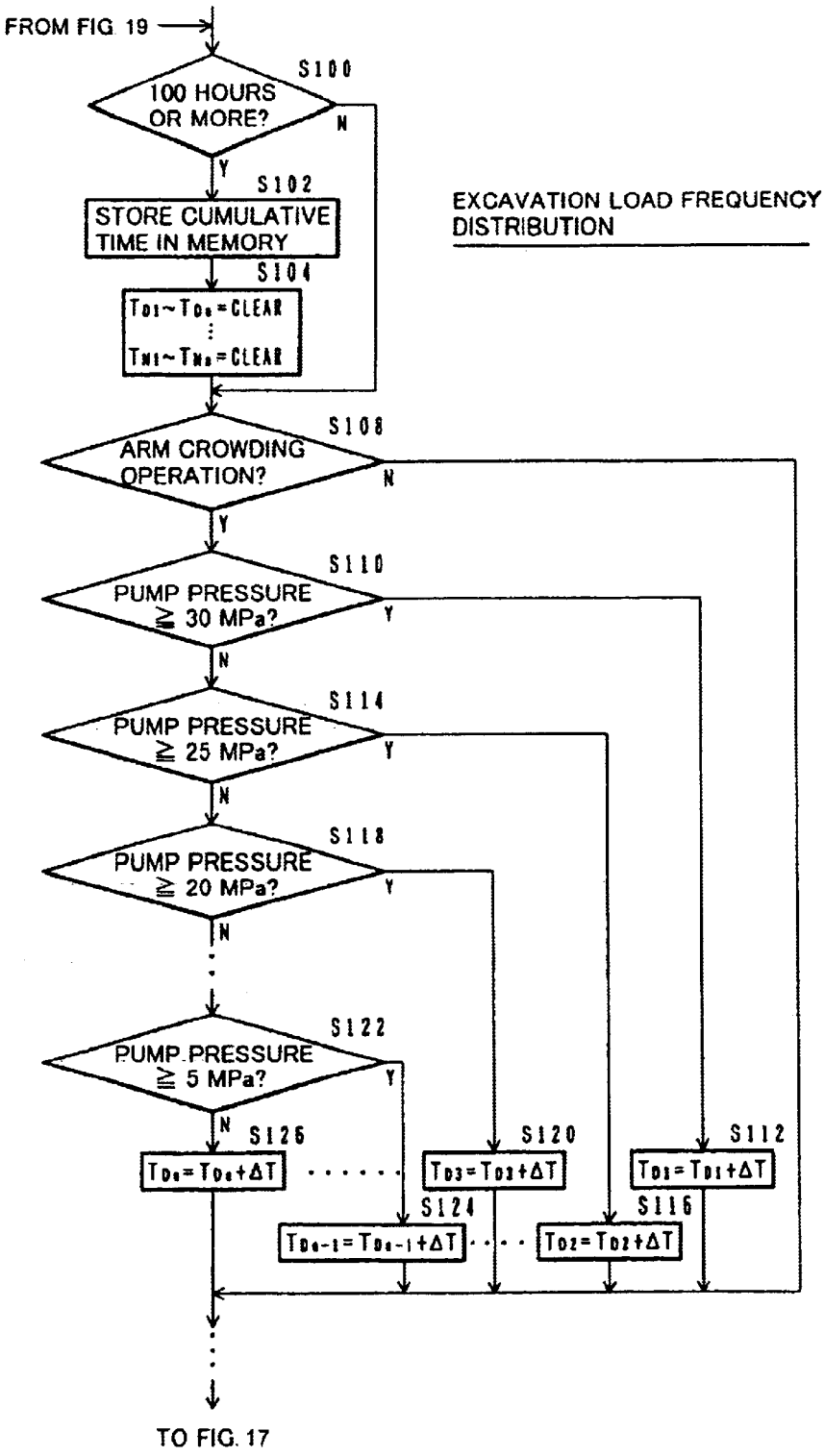
FIG. 16 is a flowchart showing details of processing procedures for creating frequency distribution data of excavation loads.

FIG. 16 is a flowchart showing details of processing procedures for creating the frequency distribution data of excavation loads.

First, the CPU determines whether the engine running time after entering this process has exceeded 100 hours (step S100). If it does not exceeded 100 hours, the CPU determines based on the signal from the sensor 40 whether the machine is during the arm crowding operation (excavation) (step S108). If the machine is during the arm crowding operation (excavation), the CPU determines based on the signal from the sensor 44 whether the pump pressure is not lower than, e.g., 30 MPa (step S110). If the pump pressure is not lower than 30 MPa, a unit time (processing cycle time) $\Delta T$ is added to a cumulative time $T_{D1}$ for a pressure range of not lower than 30 MPa and the resulted sum is set to a new cumulative time $T_{D1}$ (step S112). If the pump pressure is lower than 30 MPa, the CPU determines whether the pump pressure is not lower than 25 MPa (step S114). If the pump pressure is not lower than 25 MPa, the unit time (processing cycle time) $\Delta T$ is added to a cumulative time $T_{D2}$ for a pressure range of 25 to 30 MPa and the resulted sum is set to a new cumulative time $T_{D2}$ (step S116). Similarly, for each of other pressure ranges of 20 to 25 MPa, . . . , 5 to 10 MPa and 0 to 5 MPa, if the pump pressure falls in any of those pressure ranges, the unit time $\Delta T$ is added to a corresponding cumulative time $T_{D3}, \ldots, T_{Dn-1}, T_{Dn}$ and the resulted sum is set to a new cumulative time $T_{D3}, \ldots, T_{Dn-1}, T_{Dn}$ (steps S118 to S126).

Processing procedures for creating the frequency distribution data of swing loads and travel loads are the same as those shown in FIG. 16 except that, instead of determining in the step S108 of FIG. 16 based on the signal from the sensor 40 whether the machine is during the arm crowding operation (excavation), the CPU determines using the sensor 41 whether the machine is during the swing operation, or determines using the sensor 42 whether the machine is during the travel operation.

Figure 17:
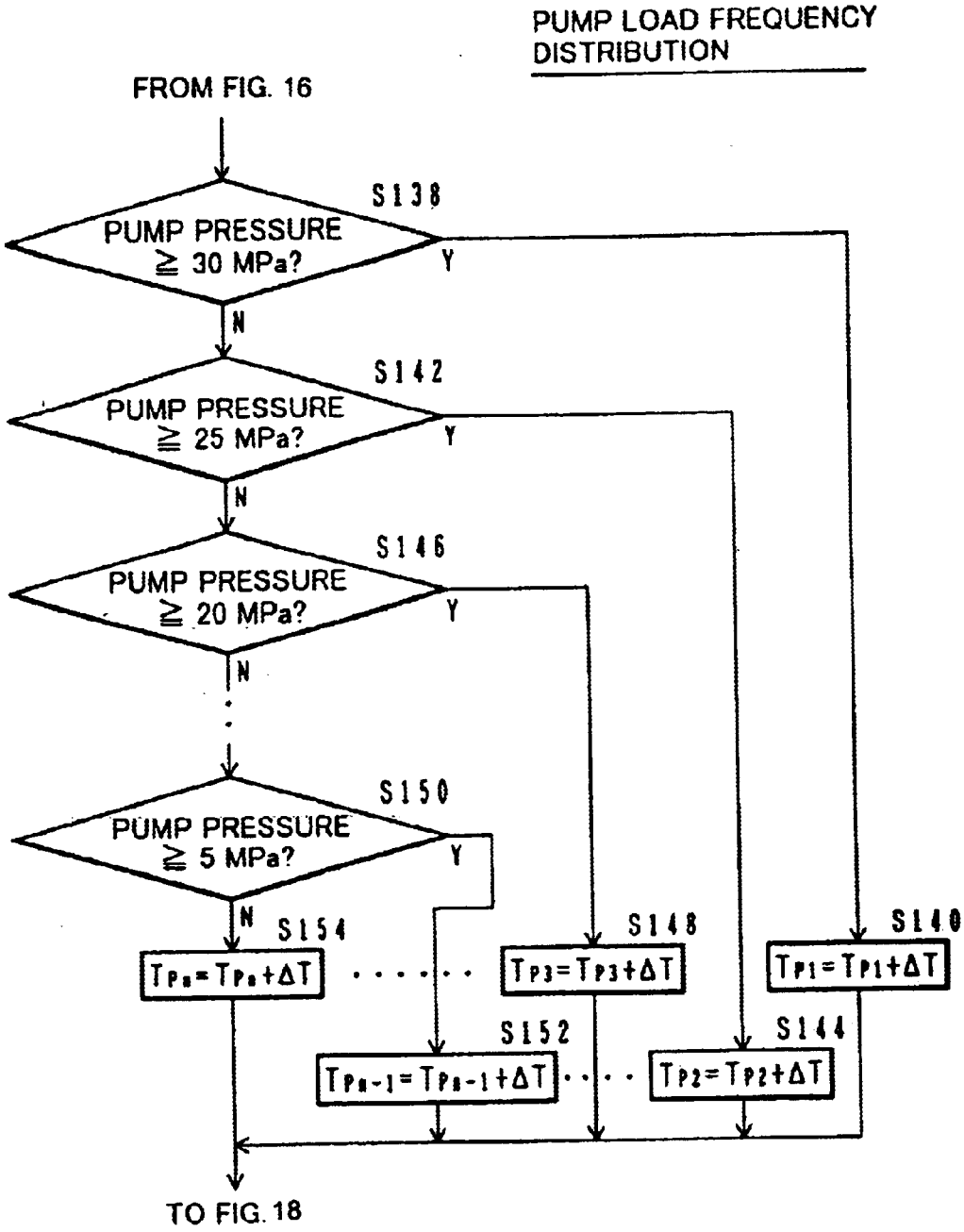
FIG. 17 is a flowchart showing details of processing procedures for creating frequency distribution data of pump loads of a hydraulic pump.

Subsequently, the CPU proceeds to processing procedures, shown in FIG. 17, for creating the frequency distribution data of pump loads of the hydraulic pumps 21*a*, 21*b*.

First, the CPU determines based on the signal from the sensor 44 whether the pump pressure is not lower than, e.g., 30 MPa (step S138). If the pump pressure is not lower than 30 MPa, the unit time (processing cycle time) $\Delta T$ is added to a cumulative time $T_{P1}$ for a pressure range of not lower than 30 MPa and the resulted sum is set to a new cumulative time $T_{P1}$ (step S140). If the pump pressure is lower than 30 MPa, the CPU determines whether the pump pressure is not lower than 25 MPa (step S142). If the pump pressure is not lower than 25 MPa, the unit time (processing cycle time) $\Delta T$ is added to a cumulative time $T_{P2}$ for a pressure range of 25 to 30 MPa and the resulted sum is set to a new cumulative time $T_{P2}$ (step S144). Similarly, for each of other pressure ranges of 20 to 25 MPa, . . . , 5 to 10 MPa and 0 to 5 MPa, if the pump pressure falls in any of those pressure ranges, the unit time $\Delta T$ is added to a corresponding cumulative time $T_{P3}, \ldots, T_{Pn-1}, T_{Pn}$ and the resulted sum is set to a new cumulative time $T_{P3}, \ldots, T_{Pn-1}, T_{Pn}$ (steps S146 to S154).

Figure 18:
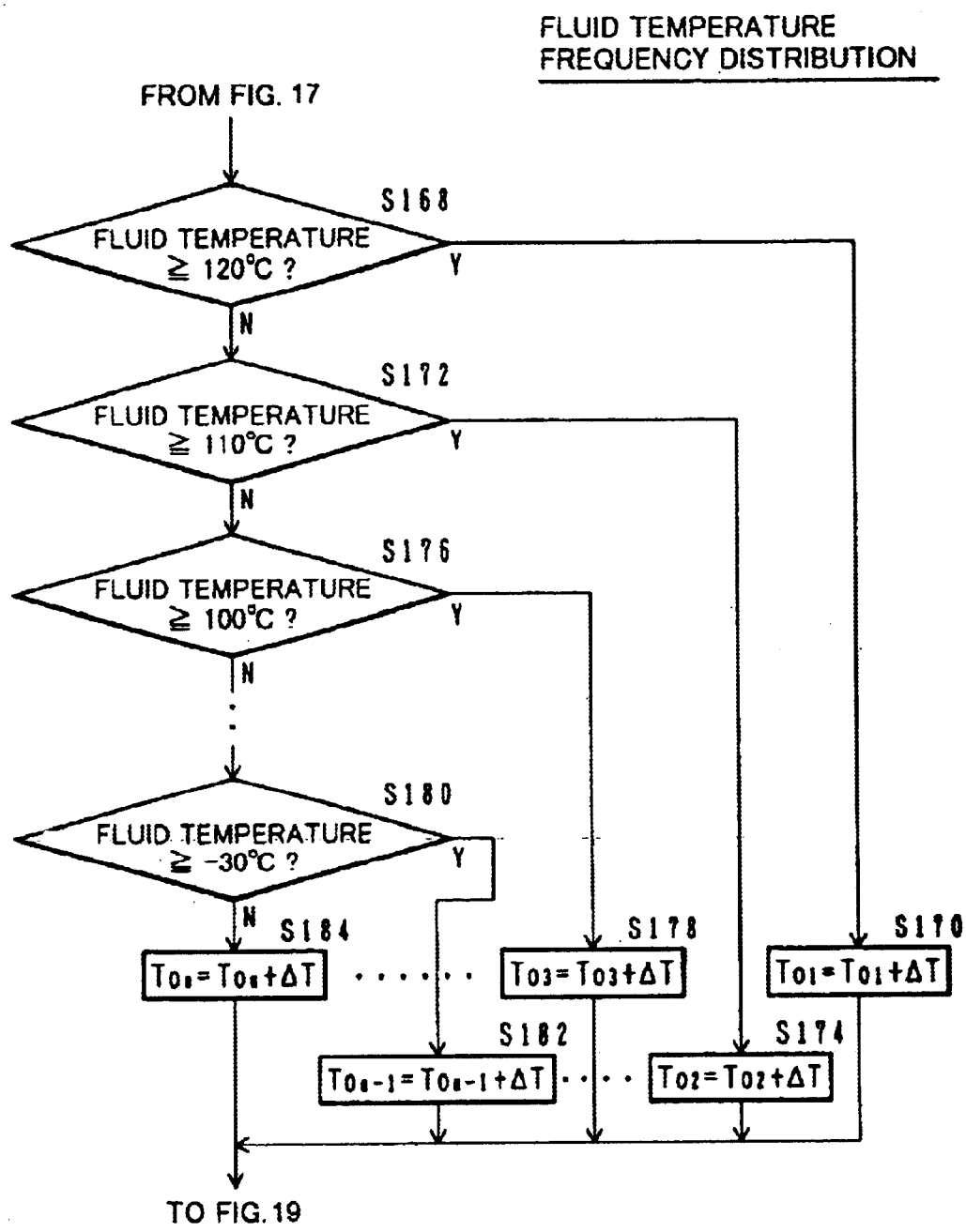
FIG. 18 is a flowchart showing details of processing procedures for creating frequency distribution data of fluid temperatures.

Subsequently, the CPU proceeds to processing procedures, shown in FIG. 18, for creating the frequency distribution data of fluid temperatures.

First, the CPU determines based on the signal from the sensor 45 whether the fluid temperature is not lower than, e.g., 120° C. (step S168). If the fluid temperature is not lower than 120° C., the unit time (processing cycle time) $\Delta T$ is added to a cumulative time $T_{01}$ for a temperature range of not lower than 120° C. and the resulted sum is set to a new cumulative time $T_{01}$ (step S170). If the fluid temperature is lower than 120° C., the CPU determines whether the fluid temperature is not lower than 110° C. (step S172). If the fluid temperature is not lower than 110° C., the unit time (processing cycle time) ΔT is added to a cumulative time $T_{02}$ for a temperature range of 110 to 120° C. and the resulted sum is set to a new cumulative time $T_{02}$ (step S714). Similarly, for each of other temperature ranges of 100 to 110° C., . . . , −30 to −20° C. and lower than −30° C., if the fluid temperature falls in any of those temperature ranges, the unit time ΔT is added to a corresponding cumulative time $T_{03}$, . . . , $T_{0n-1}$, $T_{0n}$ and the resulted sum is set to a new cumulative time $T_{03}$, . . . , $T_{0n-1}$, $T_{0n}$ (steps S176 to S184).

Subsequently, the CPU proceeds to processing procedures, shown in FIG. 19, for creating the frequency distribution data of engine revolution speeds.

First, the CPU determines based on the signal from the sensor 46 whether the engine revolution speed is not lower than, e.g., 2200 rpm (step S208). If the engine revolution speed is not lower than 2200 rpm, the unit time (processing cycle time) ΔT is added to a cumulative time $T_{N1}$ for an engine-revolution-speed range of not lower than 2200 rpm and the resulted sum is set to a new cumulative time $T_{N1}$ (step S210). If the engine revolution speed is lower than 2200 rpm, the CPU determines whether the engine revolution speed is not lower than 2100 rpm (step S212). If the engine revolution speed is not lower than 2100 rpm, the unit time (processing cycle time) ΔT is added to a cumulative time $T_{N2}$ for an engine-revolution-speed range of 2100 to 2200 rpm and the resulted sum is set to a new cumulative time $T_{N2}$ (step S214). Similarly, for each of other engine-revolution-speed ranges of 2000 to 2100 rpm, . . . , 600 to 700 rpm and lower than 600 rpm, if the engine revolution speed falls in any of those pressure ranges, the unit time ΔT is added to a corresponding cumulative time $T_{N3}$, . . . , $T_{Nn-1}$, $T_{Nn}$ and the resulted sum is set to a new cumulative time $T_{N3}$, . . . , $T_{Nn-1}$, $T_{Nn}$ (steps S216 to S224).

Figure 19:
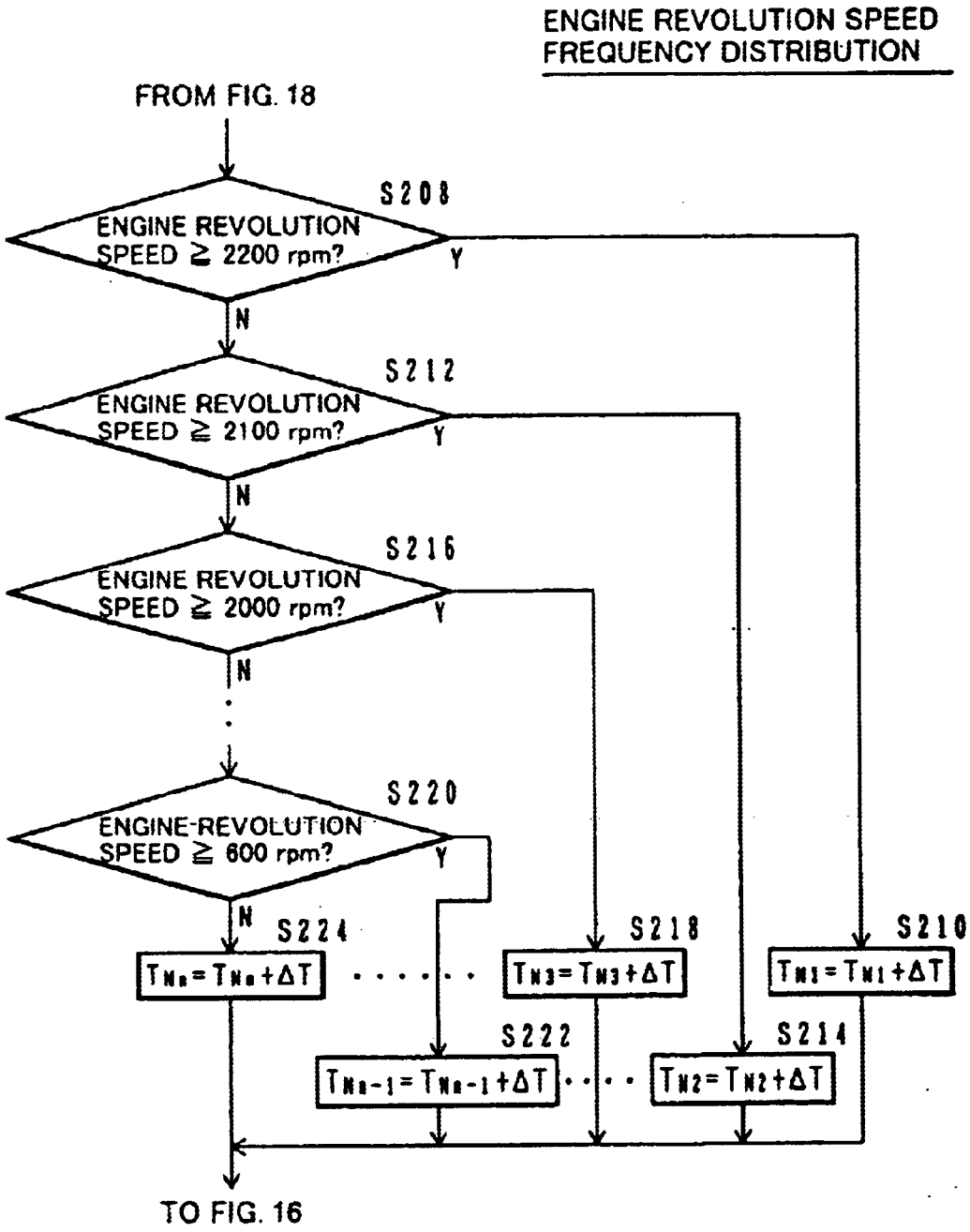
FIG. 19 is a flowchart showing details of processing procedures for creating frequency distribution data of engine revolution speeds.

After completion of the processing shown in FIG. 19, the CPU returns to the step S100 of FIG. 16 and repeats the above-described processing shown in FIGS. 16 to 19 until the engine running time exceeds 100 hours.

When the engine running time exceeds 100 hours after entering the processing shown in FIGS. 16 to 19, all data of each cumulative time $T_{D1}$ to $T_{Dn}$, $T_{S1}$ to $T_{Sn}$, $T_{T1}$ to $T_{Tn}$, $T_{P1}$ to $T_{Pn}$, $T_{01}$ to $T_{0n}$, and $T_{N1}$ to $T_{Nn}$ are stored in the memory **2*d* (step S102). Then, each cumulative time is initialized as given below; $T_{D1}$ to $T_{Dn}$=0, $T_{S1}$ to $T_{Sn}$=0, $T_{T1}$ to $T_{Tn}$=0, $T_{P1}$ to $T_{Pn}$=0, $T_{01}$ to $T_{0n}$=0, and $T_{N1}$ to $T_{Nn}$=0 (step S104**). Thereafter, similar procedures to those described above are repeated.

Figure 20:
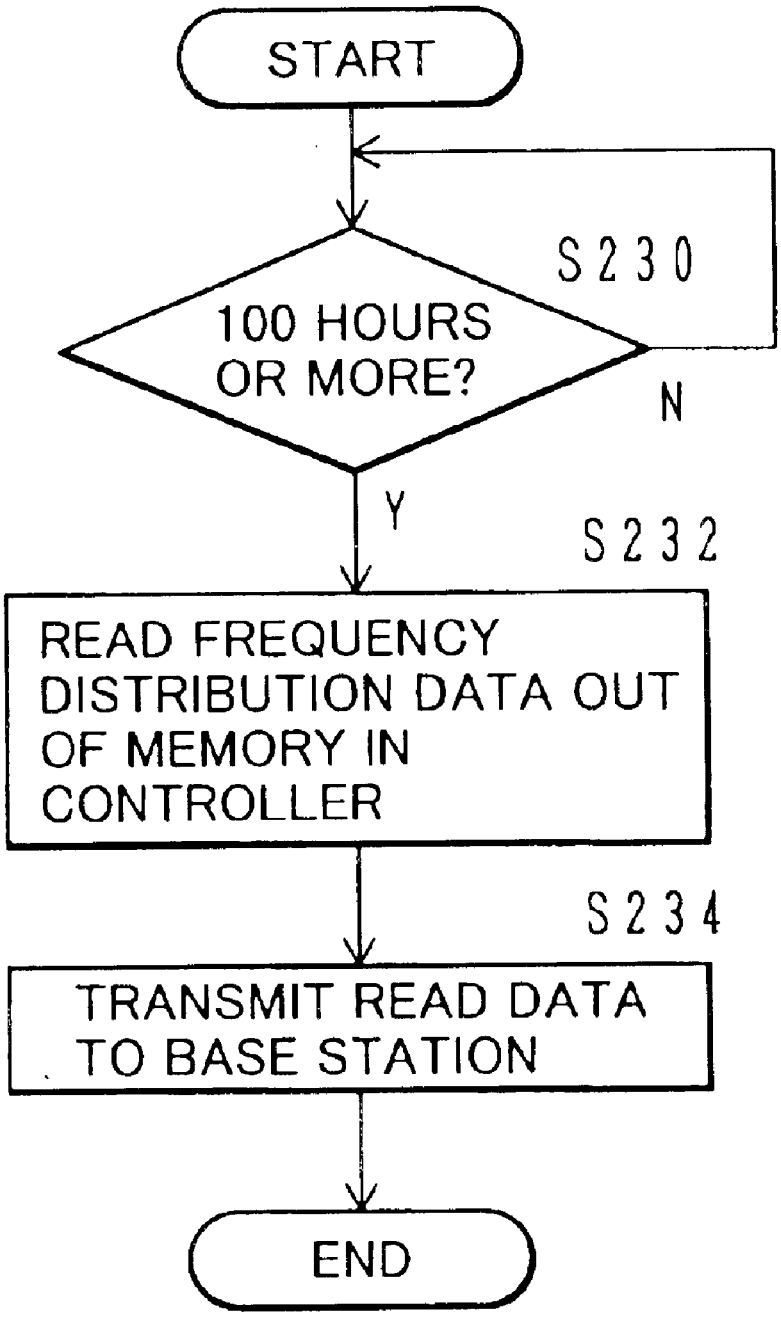
FIG. 20 is a flowchart showing the processing function of a communication control unit in the machine side controller executed when the collected frequency distribution data is transmitted.

The frequency distribution data thus collected is transmitted to the base station center server 3 by the communication control unit **2*f* in the controller 2. The processing functions of the communication control unit 2*f* on that occasion are shown in FIG. 20**.

First, in synchronism with the processing of the step S100 shown in FIG. 16, the communication control unit **2*f* monitors whether the engine running time exceeds 100 hours (step S230). If it exceeds 100 hours, the communication control unit 2*f* reads the frequency distribution data and the machine body information which are both stored and accumulated in the memory 2*d* (step S232). The read data is then transmitted to the base station center server 3 (step S234). In this way, whenever the frequency distribution data is accumulated in amount corresponding to 100 hours of the engine running time, the accumulated data is transmitted to the base station center server 3**.

The CPU **2*c* and the communication control unit 2*f* repeat the above-described processing in units of 100 hours on the basis of the engine running time. The data stored in the CPU 2*c* is erased when a predetermined number of days, e.g., 365 days (one year), have lased after the transmission to the base station center server 3**.

Figure 21:
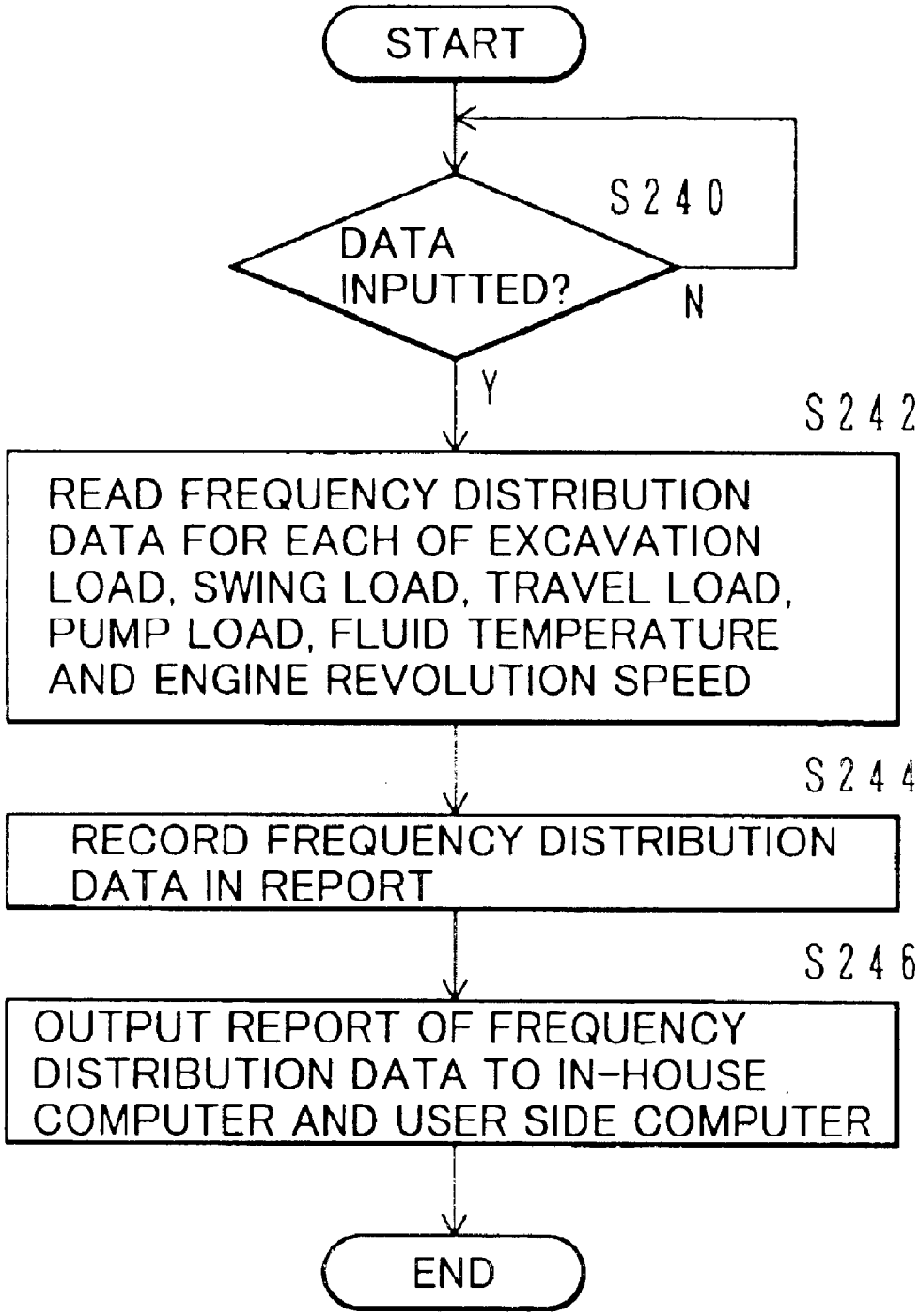
FIG. 21 is a flowchart showing the processing function of the machine body/operation information processing section and the replacement information processing section in the base station center server executed when the frequency distribution data has been transmitted from the machine side controller.

FIG. 21 is a flowchart showing the processing function of the machine body/operation information processing section 50 in the center server 3 executed when the frequency distribution data has been transmitted from the machine side controller 2.

In FIG. 21, the machine body/operation information processing section 50 monitors whether the frequency distribution data of any of excavation loads, swing loads, travel loads, pump loads, fluid temperatures and engine revolution speeds is inputted from the machine side controller 2 (step S240). When the data is inputted, the processing section 50 reads the inputted data, and then stores it as operation data (described later) in the database 100 (step S242). Subsequently, all the frequency distribution data of excavation loads, swing loads, travel loads, pump loads, fluid temperatures and engine revolution speeds are recorded as a report in the form of respective graphs (step S244). The report is then transmitted to the in-house computer 4 and the user side controller 5 (step S246).

Figure 22:
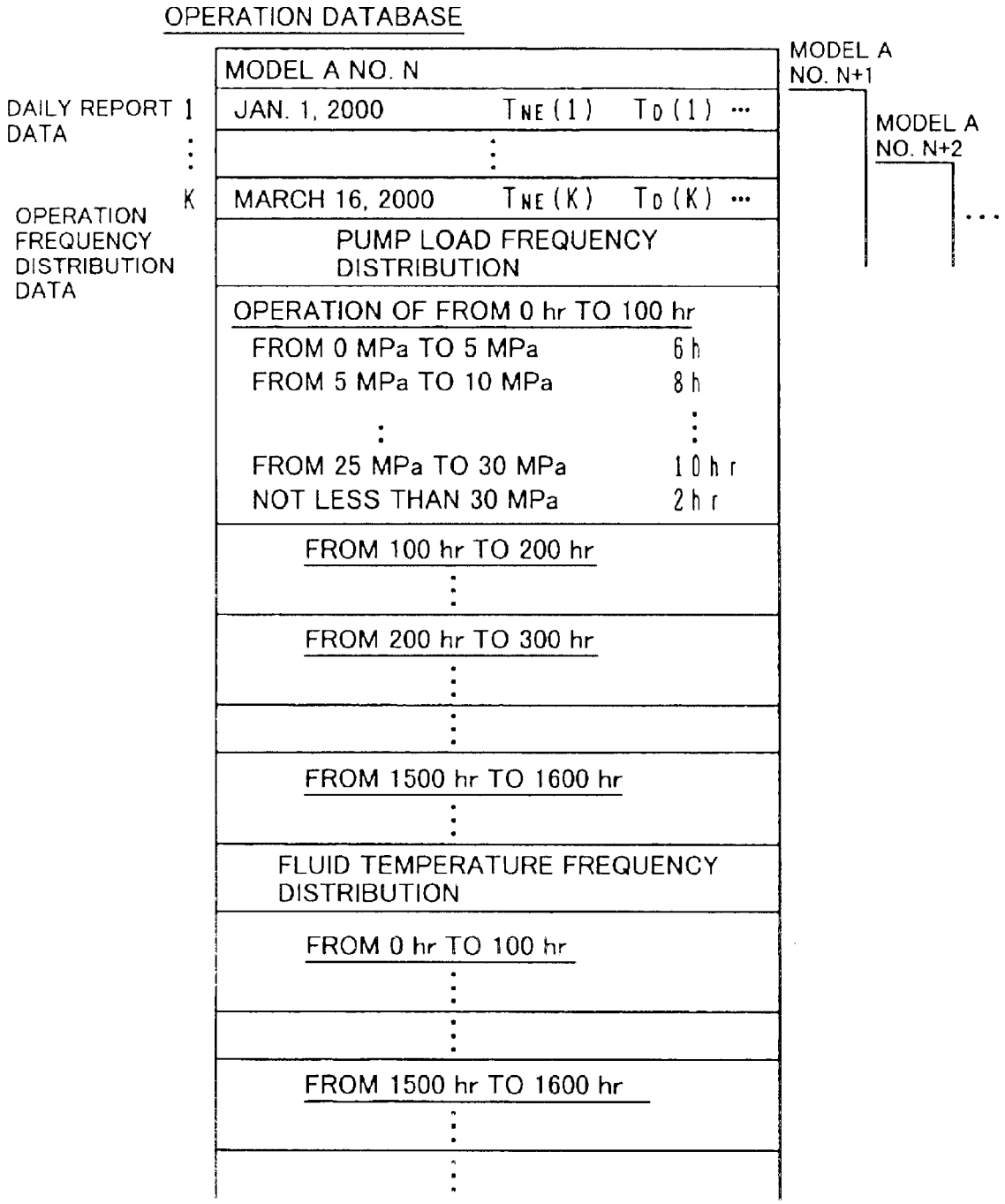
FIG. 22 shows how the frequency distribution data is stored as a database in the base station center server.

FIG. 22 shows how the frequency distribution data is stored in the database 100.

In FIG. 22, the database 100 contains the operation database section per machine model and number, as described above, in which the daily working time data per machine model and number is stored and accumulated as daily report data. Also, values of the frequency distribution data of excavation loads, swing loads, travel loads, pump loads, fluid temperatures and engine revolution speeds are stored and accumulated in the operation database per machine model and number in units of 100 hours on the basis of the engine running time. FIG. 22 shows an example of frequency distributions of pump loads and fluid temperatures of the No. N machine of model A.

In the pump load frequency distribution, for example, the working time corresponding to first 100 hours is stored in an area of from 0 hr to 100 hr divided into pump pressure ranges per 5 MPa, e.g., from 0 MPa to 5 MPa: 6 hr, from 5 MPa to 10 MPa: 8 hr, . . . , from 25 MPa to 30 MPa: 10 hr, and not less than 30 MPa: 2 hr. Also, for each subsequent unit of 100 hours, the working time is similarly stored in each of areas of from 100 hr to 200 hr, from 200 hr to 300 hr, and from 1500 hr to 1600 hr.

The frequency distributions of excavation loads, swing loads and travel loads, the frequency distribution of fluid temperatures, and the frequency distribution of engine revolution speeds are also stored in a similar manner. Note that, in the frequency distributions of excavation loads, swing loads and travel loads, the loads are represented on the basis of pump loads. More specifically, respective values of the working time-associated with excavation, swing and travel are collected for each of pressure ranges on the basis of pump pressure, e.g., from 0 MPa to 5 MPa, from 5 MPa to 10 MPa, . . . , from 25 MPa to 30 MPa, and not less than 30 MPa. Then, the collected values are provided as the frequency distributions of excavation loads, swing loads and travel loads.

Figure 23:
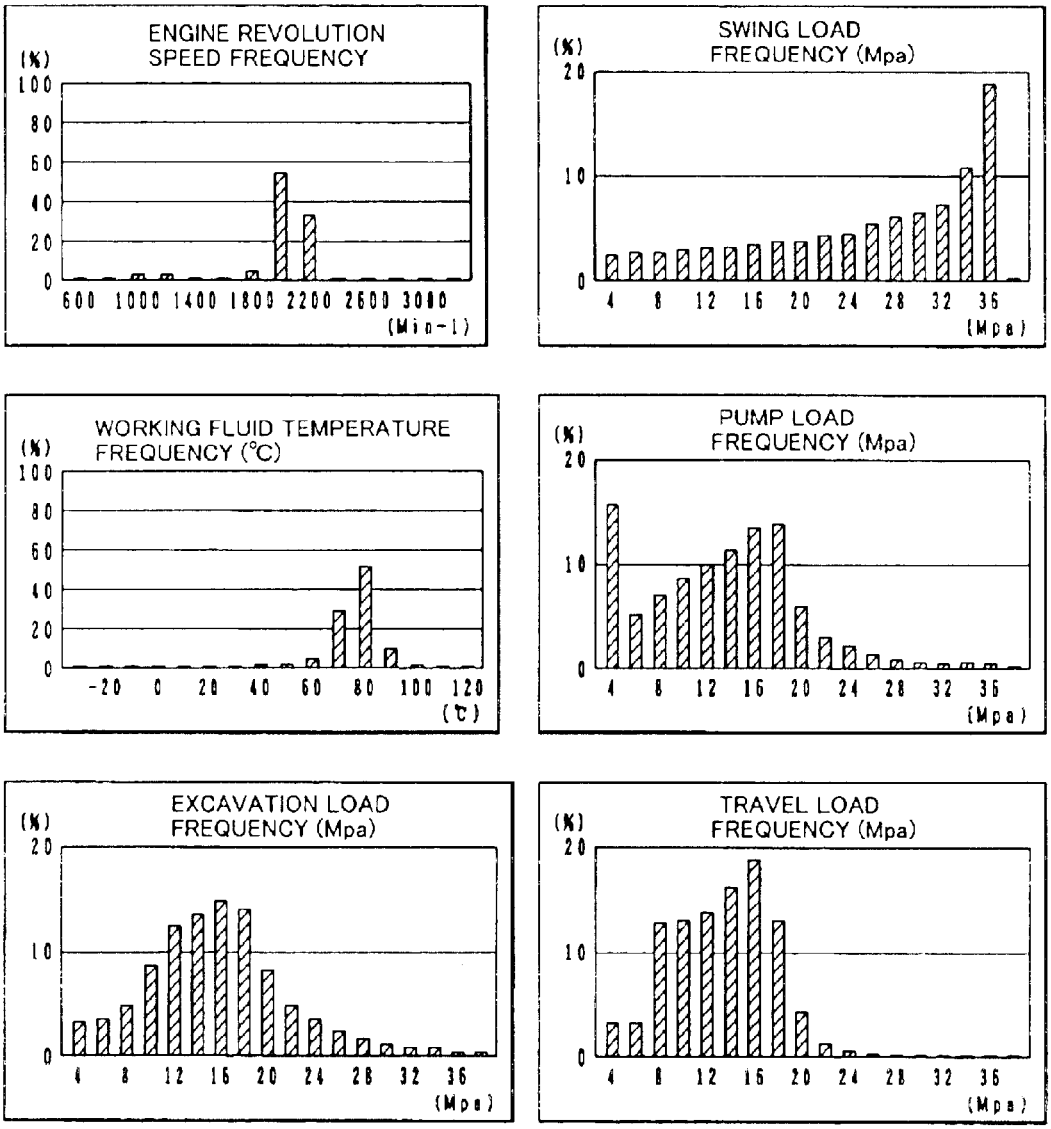
FIG. 23 shows one example of a frequency distribution data report transmitted to the in-house computer and the user side computer.

FIG. 23 shows one example of a frequency distribution data report transmitted to the in-house computer 4 and the user side computer 5. In the illustrated example, each load frequency distribution is represented as a proportion with respect to the corresponding working time within 100 hours of the engine running time. More specifically, in the frequency distribution of excavation loads, for example, the excavation time (e.g., 60 hours) within 100 hours of the engine running time is assumed to be 100%, and the cumulative time for each of the pressure ranges on the basis of the pump pressure is indicated as a percentage (%) with respect to 60 hours. The frequency distributions of swing loads, travel loads and pump loads are also represented in a similar manner. In the frequency distributions of fluid temperatures and engine revolution speeds, 100 hours of the engine running time is assumed to be 100%, and the cumulative time for each unit range is indicated as a percentage with respect to 100 hours. By looking at those reports, the user is able to confirm situations in use of the hydraulic excavator per section depending on loads.

The function of collecting warning data, executed in the machine side controller 2, will be described. The controller 2 has the failure diagnosing function, and each time warning is issued based on the failure diagnosing function, the controller 2 transmits the warning to the base station center server 3 from the communication control unit 2*f*. The base station center server 3 stores the warning information in the database, makes a report, and transmits it to the in-house computer 4 and the user side computer 5.

FIG. 24 shows one example of such a report. In the illustrated example, details of the warnings are represented in the form of a table in correspondence to the date.

With this embodiment constructed as described above, the sensors 40 to 46 and the controller 2 are provided as operation data measuring and collecting means in each of the plurality of hydraulic excavators 1. In each hydraulic excavator, the sensors 40 to 46 and the controller 2 measure and collect the working time for each of a plurality of sections (i.e., the engine 32, the front 15, the swing body 13 and the travel body 12) that differ in working time from each other. The collected working time for each section is transferred to the base station computer 3 and then stored and accumulated therein as operation data. In the base station computer 3, the operation data of a particular hydraulic excavator is read out, and the working time for each part is calculated on the basis of the working time of the section to which the relevant part belongs. The calculated working time is compared with the preset target replacement time interval, and the remaining time up to next replacement of the relevant part is calculated. Even in a hydraulic excavator having a plurality of sections (i.e., the engine 32, the front 15, the swing body 13 and the travel body 12) that differ in working time from each other, therefore, the appropriate scheduled replacement timing of the part can be determined. Accordingly, the part can be avoided from being replaced in spite of being still usable, can be economically used at minimum waste, and can be surely replaced by a new part before the occurrence of a failure. Further, since the appropriate scheduled replacement timing of each part can be determined, it is possible to predict the timing of ordering new parts and the timing of sending the serviceman with certainty, and to facilitate the maintenance management on the maker side.

Also, since the scheduled replacement timing of respective parts in a plurality of hydraulic excavators can be managed together in the base station computer 3, the management of parts maintenance can be collectively performed on the maker side.

Further, since the maintenance information can be provided as a maintenance report to the user side as well, the user is also to estimate the replacement timing of parts of the owned hydraulic excavator and hence to take proper actions for maintenance.

In addition, since the daily report of the operation information, the diagnostic report indicating the results of maintenance and check, and the warning report are provided to the user side as appropriate, the user is able to confirm situations in operation of the owned hydraulic excavator everyday and hence to perform management of the hydraulic excavator more easily.

A second embodiment of the present invention will be described with reference to FIGS. 25 to 30. This embodiment is intended to not only replace parts, but also manage the timing of part repair (overhaul).

The overall construction of a management system for a construction machine according to this embodiment is the same as that in the first embodiment, and the system configuration is similar to that in the first embodiment shown in FIGS. 1 to 3. Also, the machine side controller has the same processing functions as those in the first embodiment, and the base station center server has the same processing functions as those described above with reference to FIGS. 4, 7 to 14, and 21 to 24 except for the following point. The different point in the processing functions of the base station center server in this embodiment from those in the first embodiment will be described below.

Figure 25:
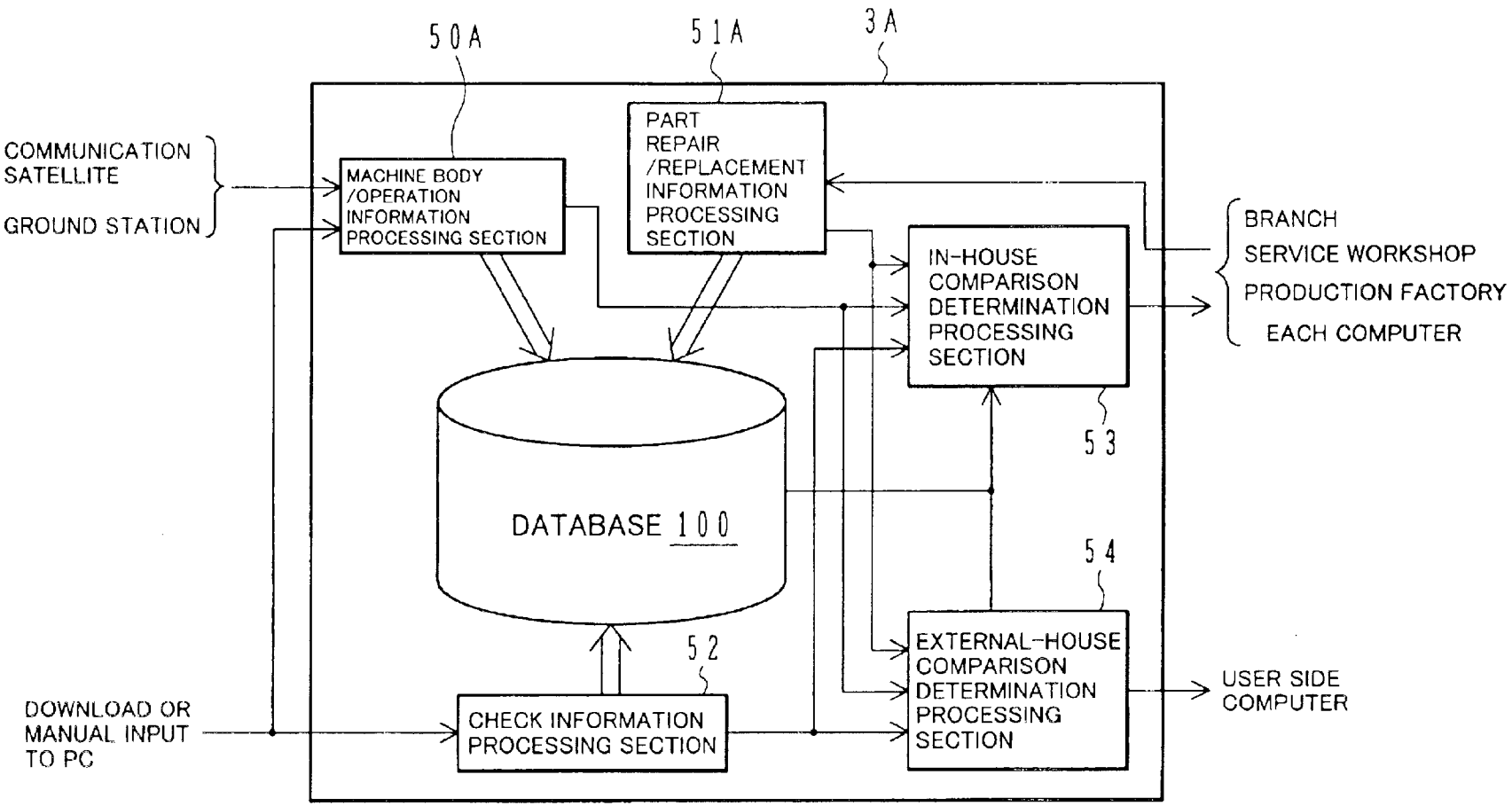
FIG. 25 is a functional block diagram showing an outline of processing functions of a CPU in a base station center server in a management system for a construction machine according to a second embodiment of the present invention.

FIG. 25 is a functional block diagram showing an outline of processing functions of the CPU 3*c* (see FIG. 1) in a base station center server 3A. The CPU 3*c* includes a machine body/operation information processing section 50A and a part repair/replacement information processing section 51A instead of the machine body/operation information processing section 50 and the part replacement information processing section 51 shown in FIG. 4. The machine body/operation information processing section 50A executes processing shown in FIG. 26 based on operation information inputted from the machine side controller 2. The part repair/replacement information processing section 51A executes processing shown in FIG. 27 based on part replacement information inputted from the in-house computer 4. The other processing sections are the same as those described above in connection with the first embodiment shown in FIG. 4.

Figure 26:
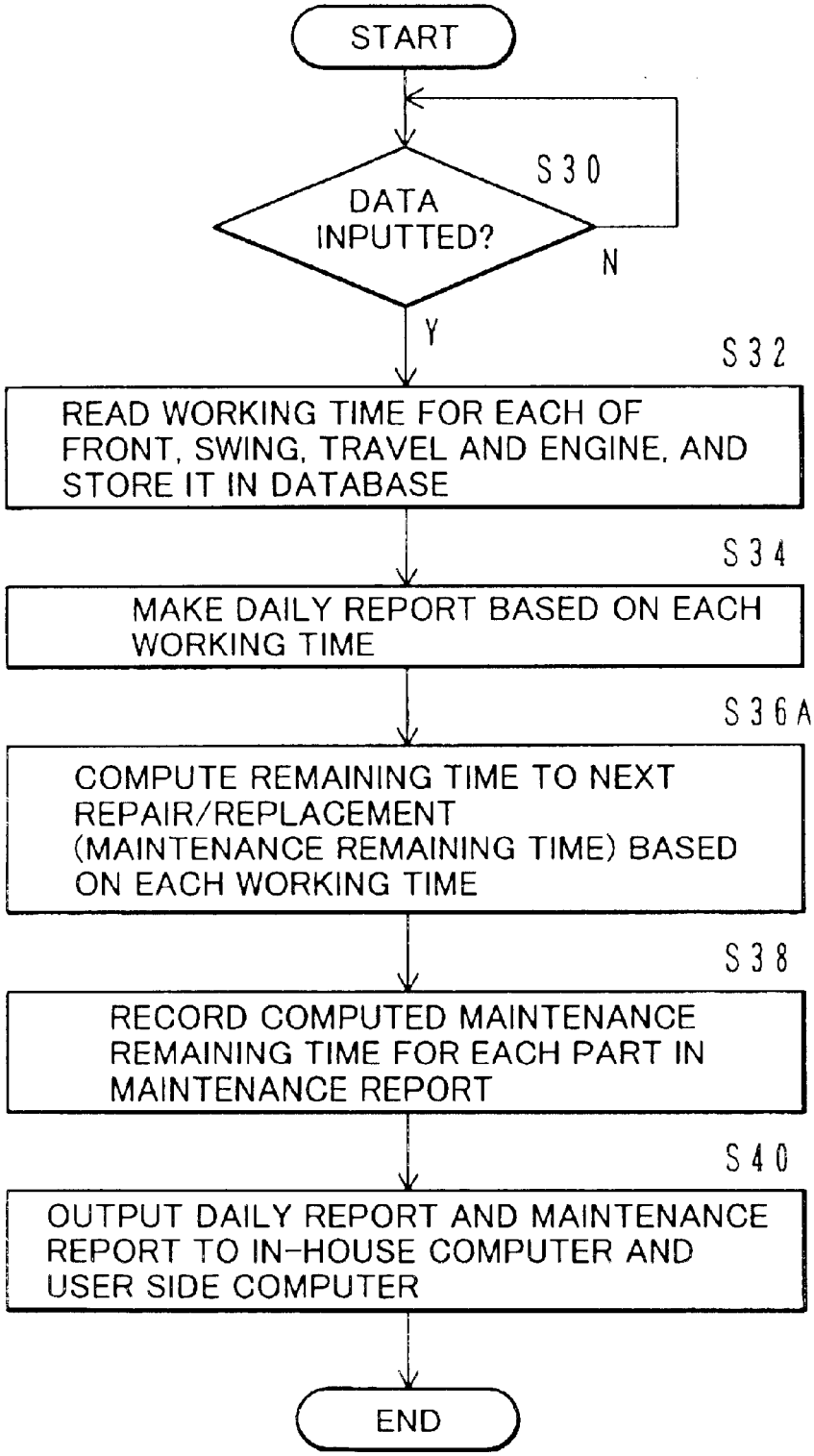
FIG. 26 is a flowchart showing the processing function of a machine body/operation information processing section in the base station center server executed when the working time data has been transmitted from the machine side controller.

In FIG. 26, the machine body/operation information processing section 50A reads in step S36A, out of the database 100, the operation data, actual maintenance data (described later) and target maintenance data (described later), and computes the remaining time up to next repair or replacement (hereinafter referred to as the "maintenance remaining time") for each part on the basis of the working time per section to which the relevant part belongs. The other processing procedures are the same as those in the first embodiment shown in FIG. 7.

Figure 27:
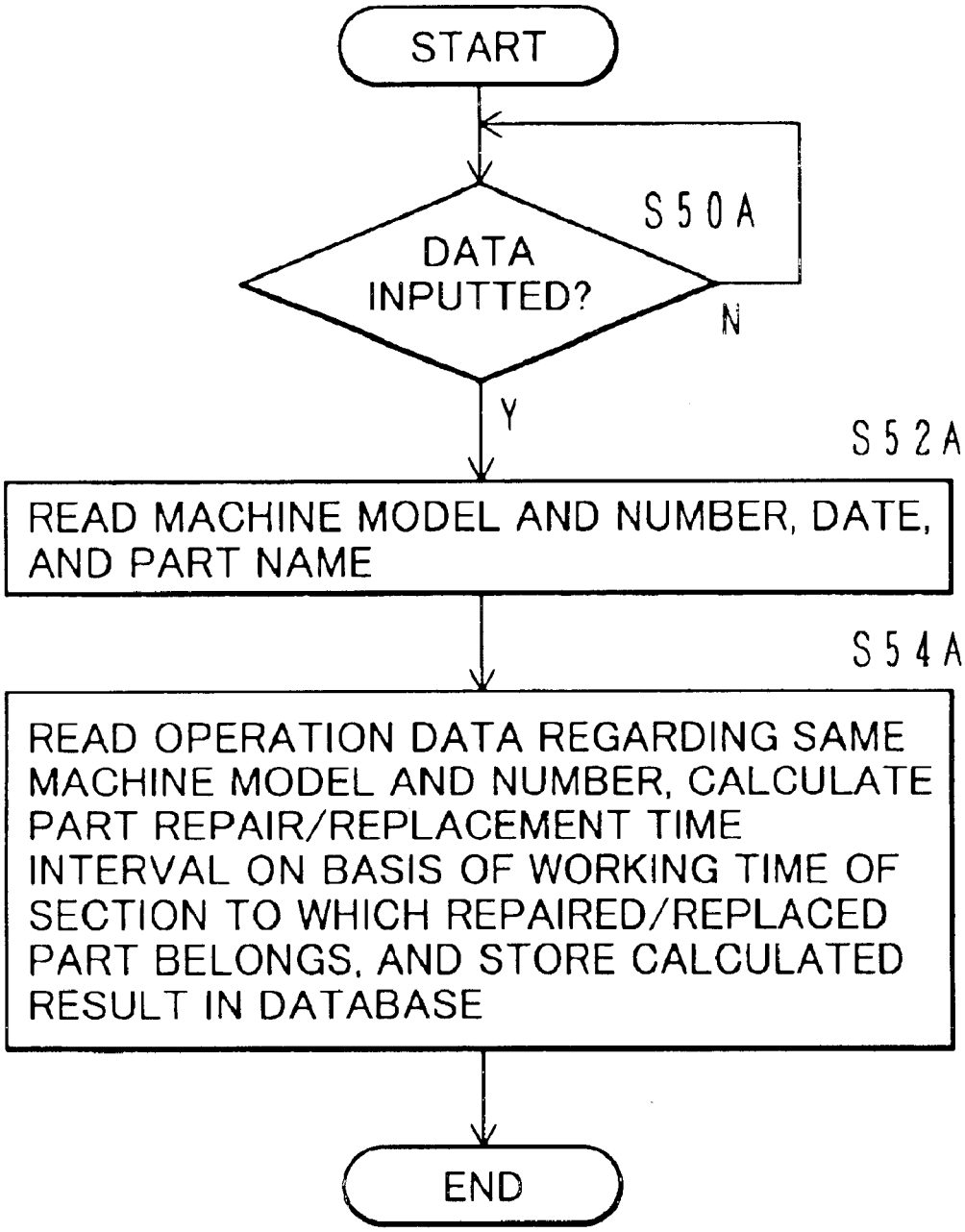
FIG. 27 is a flowchart showing the function of processing part repair/replacement information executed in a part repair/replacement information processing section of the base station center server.

In FIG. 27, the part repair/replacement information processing section 51A monitors whether the part repair/replacement information is inputted from the in-house computer 4 by, e.g., the serviceman (step S50A). When the part repair/replacement information is inputted, the processing section 51A reads the inputted information (step S52A). Herein, the part repair/replacement information contains the machine number of a hydraulic excavator whose part has been repaired or replaced, the repairing or replacement date, and the name of the repaired or replaced part.

Then, the processing section 51A accesses the database 100, reads the operation data regarding the same machine number, and calculates a repair/replacement time interval of each repaired or replaced part on the basis of the working time of the section to which the relevant part belongs, followed by storing and accumulating the calculated result in the database 100 as actual maintenance data (step S54A).

Herein, the part repair/replacement time interval means a time interval from the time at which one part was assembled in the machine body, to the time at which it was replaced by a new one or repaired (overhauled) because of a failure or expiration of the life. As mentioned above, the part repair/replacement time interval is calculated on the basis of the working time of the section to which the relevant part belongs. Taking the engine as an example, the section to which the engine belongs is the engine itself. Then, if the engine running time until repair of the engine is 4100 hours, the repair time interval of the engine is calculated as 4100 hours.

FIGS. 28 and 29 show how the actual maintenance data and the target maintenance data are stored in the database 100.

Referring to FIG. 28, in the actual maintenance database per machine model and number, the repair/replacement time interval of each of parts, which have been repaired or replaced in the past, is stored per machine model and number as a cumulative value on the basis of the working time of the section to which the relevant part belongs. In the illustrated example, replacement time intervals $T_{EF}(i)$ and $T_{FB}(i)$ of the engine oil filter and the front bushing are the same as those in the first embodiment described above with reference to FIG. 9. $T_{ENR}(1)$ and $T_{ENR}(K)$ represent respective cumulative values of the repair time intervals after the first and K-th repair of the engine of the No. N machine of model A (e.g., 4100 hr and 18000 hr on the basis of the engine running time). $T_{HP}(1)$ and $T_{HP}(N)$ represent respective cumulative values of the repair time intervals after the first and N-th replacement of the hydraulic pump of the No. N machine (e.g., 2500 hr and 16200 hr on the basis of the engine running time). Similar data is also stored for a No. N+1 machine, a No. N+2 machine, . . . of model A. Note that the working time of the hydraulic pump may be given as a time during which the pump delivery pressure is not lower than a predetermined level.

Referring to FIG. 29, in the target maintenance database per machine model, the target repair/replacement time interval of each of parts used in each machine model is stored per machine model as a value on the basis of the working time of the section to which the relevant part belongs. In an illustrated example, the target replacement time interval $T_{M\text{-}EF}$ of the engine oil filter and the target replacement time interval $T_{M\text{-}FB}$ of the front bushing have already been described above in the first embodiment with reference to FIG. 9. Further, $T_{M\text{-}EN}$ represents the target repair time interval of the engine used in the machine model A (e.g., 6000 hr on the basis of the engine running time), and $T_{M\text{-}HP}$ represents the target repair time interval of the hydraulic pump used in the machine model A (e.g., 5000 hr on the basis of the engine running time). Similar data is also stored for all other machine models B, C, . . . .

Using the data stored in the operation database described with reference to FIG. 9, and the data stored in the actual maintenance database and the target maintenance database shown respectively in FIGS. 28 and 29, the machine body/operation information processing section 50A computes, in the step S36A of FIG. 26, not only the maintenance (replacement) remaining time for each part as shown in FIGS. 10 and 11, but also the repair remaining time of each part on the basis of the working time per section, to which the relevant part belongs, in accordance with procedures shown in a flowchart of FIG. 30.

Figure 30:
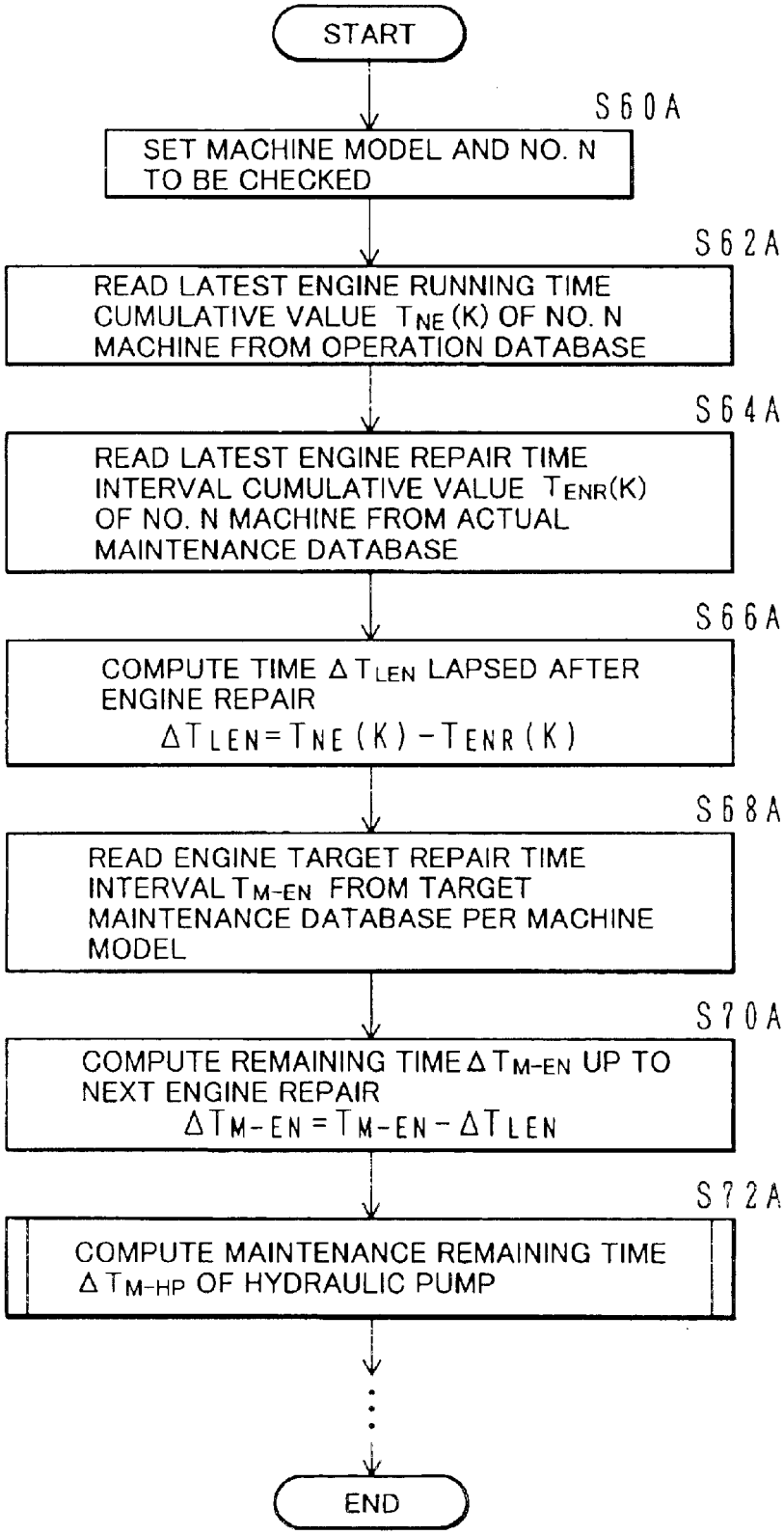
FIG. 30 is a flowchart showing a manner of calculating the maintenance remaining time.

Referring to FIG. 30, the machine body/operation information processing section 50A first sets the machine model and number (e.g., N) of the hydraulic excavator to be checked (step S60A). Then, the processing section 50A reads the latest engine-running-time cumulative value $T_{NE}(K)$ of the No. N machine of the set model from the operation database (step S62A). Also, it reads the latest engine-repair time interval cumulative value $T_{ENR}(K)$ of the No. N machine of the set model from the actual maintenance database (step S64A). Thereafter, a time $\Delta T_{LEN}$ lapsed after the last repair of the engine is computed from the following formula (step S66A):

$$\Delta T_{LEN}=T_{NE}(K)-T_{ENR}(K)$$

Further, the processing section 50A reads the engine target repair time interval $T_{M\text{-}EN}$ from the target maintenance database per machine model (step S68A). Then, the remaining time $\Delta T_{M\text{-}EN}$ up to next repair of the engine is computed from the following formula (step S70A):

$$\Delta T_{M\text{-}EN}=T_{M\text{-}EN}-\Delta T_{LEN}$$

As a result, the remaining time up to next repair of the engine in the No. N machine of the set model is computed as $\Delta T_{M\text{-}EN}$.

The repair remaining time is similarly calculated for other parts, e.g., the hydraulic pump (step S72A).

With this embodiment, the appropriate scheduled repair timing can also be decided even for a part, such as the engine and the hydraulic pump, to be repaired in the event of a failure. Accordingly, the part can be avoided from being repaired in spite of being still usable, can be economically used at minimum waste, and can be surely repaired before the occurrence of a failure. Further, since the appropriate maintenance timing (scheduled repair timing) of the part can be determined, it is possible to predict the timing of ordering new parts and the timing of sending the serviceman with certainty, and to facilitate the maintenance management on the maker side.

Also, since the scheduled repair/replacement timing of respective parts in a plurality of hydraulic excavators can be managed together in the base station computer 3, the management of parts maintenance can be collectively performed on the maker side.

Further, since the maintenance information can be provided as a maintenance report to the user side as well, the user is also able to estimate the repair/replacement timing of parts of the owned hydraulic excavator and hence to take proper actions for maintenance.

In the above-described embodiments, the center server 3 not only calculates the maintenance remaining time, but also prepares and transmits the maintenance report everyday, in addition to preparation and transmission of the daily report. However, those processes are not necessarily performed everyday, and may be performed at different frequency, for example, such that only the maintenance remaining time is calculated everyday and the maintenance report is prepared and transmitted once a week. Alternatively, the maintenance remaining time may be automatically calculated in the center server 3, and the maintenance report may be prepared and transmitted using the in-house computer in response to an instruction from the serviceman. Further, the calculation of the maintenance remaining time and the preparation and transmission of the maintenance report may be both performed in response to an instruction from the serviceman. In addition, the maintenance report may be mailed to the user in the form of prints, such as postcards. Alternatively, the maintenance report may be put on the maker's homepage, and the user may access the maintenance report on the Internet.

Moreover, while the engine running time is measured using the engine revolution speed sensor 46, it may be measured by a combination of a timer and a signal that is resulted from detecting turning-on/off of the engine key switch by the sensor 43. As an alternative, the engine running time may be measured by a combination of a timer and turning-on/off of a power generation signal from an alternator associated with the engine, or by rotating an hour meter with power generated by the alternator.

Additionally, while the information created by the center server 3 is transmitted to the user-side and in-house computers, it may also be returned to the side of the hydraulic excavator 1.

While the diagnostic report of maintenance/check and the warning report are also transmitted to the user side as well along with the daily report and the maintenance report, the former reports may be transmitted to only the in-house computer depending on the contents thereof. Alternatively, those reports may be put on the homepage so that the user may access the maintenance report on the Internet.

While, in the above-described embodiments, the present invention is applied to a crawler type hydraulic excavator, the present invention is similarly applicable to other types of construction machines, such as wheel type hydraulic excavators, wheel loaders, hydraulic cranes, and bulldozers.

INDUSTRIAL APPLICABILITY

According to the present invention, the appropriate scheduled repair/replacement timing of parts can be decided even in a construction machine having a plurality of sections that differ in working time from each other.

Also, according to the present invention, the scheduled repair/replacement timing of respective parts in a plurality of construction machines can be managed together in a base station.

What is claimed is:

1. A method for managing a construction machine, the method comprising:

a first step of measuring a working time for each of sections in each of a plurality of construction machines, transferring the measured working time for each section to a base station computer, and storing and accumulating the transferred working time as operation data in a database;

a second step of, in base station computer, reading the operation data regarding a particular construction machine from said database and calculating a scheduled repair/replacement timing of a part belonging to each section on the basis of the working time of said section.

a third step of executing processing to allow a maker and a user of said particular construction machine to learn said scheduled repair/replacement timing calculated in said second step, respectively.

2. A method for managing a construction machine according to claim 1, wherein said second step includes steps of calculating, based on said read operation data, a working time of a part belonging to each section on the basis of the working time of said section, and comparing the calculated working time with a preset target repair/replacement time interval, thereby calculating a remaining time up to next repair/replacement of the relevant part.

3. A method for managing a construction machine according to claim 1, wherein said construction machine is a hydraulic excavator, and said sections include a front, a swing body, a travel body, an engine, and a hydraulic pump of the hydraulic excavator.

4. A system for managing a construction machine, the system comprising:

operation data measuring and collecting means for measuring and collecting a working time for each of sections in each of a plurality of construction machines; and a base station computer installed in a base station and having a database for storing and accumulating, as operation data, the working time measured and collected for each section, said base station computer including first means for reading the operation data of a particular construction machine from said database and calculating a scheduled repair/replacement timing of a part belonging to each section on the basis of the working time of said section and second means for executing processing to allow a maker and a user of said particular construction to learn said scheduled repair/replacement timing calculated by said first means respectively.

5. A system for managing a construction machine according to claim 4, wherein said first means calculates, based on said read operation data, a working time of a part belonging to each section on the basis of the working time of said section, and compares the calculated working time with a preset target repair/replacement time interval, thereby calculating a remaining time up to next repair/replacement of the relevant part.

6. A system for managing a construction machine according to claim 4, wherein said construction machine is a hydraulic excavator, and said sections include a front, a swing body, a travel body, an engine, and a hydraulic pump of the hydraulic excavator.

7. A processing apparatus comprising: a database for storing and accumulating, as operation data, a working time for each of sections in each of a plurality of construction machines, first means for reading the operation data regarding a particular construction machine from said database, and calculating a scheduled repair/replacement timing of a part belonging to each section on the basis of the working time of said section, and second means for executing processing to allow a maker and a user of said particular construction to learn said scheduled repair/replacement timing calculated by said first means respectively.

8. A processing apparatus comprising: a database for storing and accumulating, as operation data, a working time for each of sections in each of a plurality of construction machines, first means for reading the operation data regarding a particular construction machine from said database, calculating a working time of a part belonging to each section on the basis of the working time of said section, and comparing the calculated working time with a preset target repair/replacement time interval, thereby calculating a remaining time up to next repair/replacement of the relevant part, and second means for executing processing to allow a maker and user of said particular construction to learn said scheduled repair/replacement timing calculated by said first means respectively.

* * * * *